US010601141B2

(12) United States Patent
Kawata

(10) Patent No.: US 10,601,141 B2
(45) Date of Patent: Mar. 24, 2020

(54) ARTIFICIAL MAGNET CONDUCTOR, ANTENNA REFLECTOR, AND METHOD FOR CALCULATING THICKNESS OF DIELECTRIC MEDIUM

(71) Applicant: Yamaha Corporation, Hamamatsushi, Shizuoka (JP)

(72) Inventor: Akihiro Kawata, Tokyo (JP)

(73) Assignee: Yamaha Corporation, Hamamatsu-shi (JP)

( * ) Notice: Subject to any disclaimer, the term of this patent is extended or adjusted under 35 U.S.C. 154(b) by 672 days.

(21) Appl. No.: 15/315,889

(22) PCT Filed: Jun. 4, 2015

(86) PCT No.: PCT/JP2015/066252
§ 371 (c)(1),
(2) Date: Dec. 2, 2016

(87) PCT Pub. No.: WO2015/186805
PCT Pub. Date: Dec. 10, 2015

(65) Prior Publication Data

US 2017/0098894 A1 Apr. 6, 2017

(30) Foreign Application Priority Data

Jun. 4, 2014 (JP) ..... 2014-115956

(51) Int. Cl.
*H01Q 15/00* (2006.01)
*H01Q 15/14* (2006.01)
(Continued)

(52) U.S. Cl.
CPC ..... *H01Q 15/004* (2013.01); *H01Q 1/38* (2013.01); *H01Q 1/48* (2013.01); *H01Q 7/00* (2013.01);
(Continued)

(58) Field of Classification Search
None
See application file for complete search history.

(56) References Cited

U.S. PATENT DOCUMENTS 6,218,978 B1 4/2001 Simpkin et al.
8,957,808 B2 * 2/2015 Ookawa ..... G01S 7/4004 342/165
(Continued)

FOREIGN PATENT DOCUMENTS

CN 101894990 A 11/2010
CN 103594791 A 2/2014
(Continued)

OTHER PUBLICATIONS

A. J. Roscoe and R. A. Perrott, "Large finite array analysis using infinite array data," in IEEE Transactions on Antennas and Propagation, vol. 42, No. 7, pp. 983-992, (Year: 1994).*
(Continued)

*Primary Examiner* — Roy Y Yi
(74) *Attorney, Agent, or Firm* — Crowell & Moring LLP

(57) ABSTRACT

An artificial magnet conductor includes a dielectric medium, basic cells, each being formed on a side of a front surface of the dielectric medium, and including a conductive patch pattern and a conductive loop pattern formed with a predetermined gap with the conductive patch pattern, a frequency selective surface on which the basic cells are periodically arranged on the front surface of the dielectric medium, and a conductive layer formed on a side of a rear surface of the dielectric medium. A phase change from an incident wave to a reflected wave with respect to the dielectric medium is set as an addition value in which a first phase change in the gap is added to a second phase change between the basic cell of
(Continued)

the dielectric medium and the conductive layer. A thickness of the dielectric medium is calculated using the addition value.

18 Claims, 12 Drawing Sheets

(51) Int. Cl.
*H01Q 1/38* (2006.01)
*H01Q 1/48* (2006.01)
*H01Q 7/00* (2006.01)
*H01Q 9/04* (2006.01)

(52) U.S. Cl.
CPC ..... *H01Q 9/0407* (2013.01); *H01Q 15/002* (2013.01); *H01Q 15/006* (2013.01); *H01Q 15/0013* (2013.01); *H01Q 15/0046* (2013.01); *H01Q 15/14* (2013.01)

(56) References Cited

U.S. PATENT DOCUMENTS

| | | | | |
|---|---|---|---|---|
| 2005/0207518 | A1* | 9/2005 | Toncich | H03C 3/20 375/347 |
| 2009/0096688 | A1 | 4/2009 | Akiyama et al. | |
| 2010/0001080 | A1* | 1/2010 | Sim | H01O 1/2208 235/492 |
| 2014/0294121 | A1* | 10/2014 | Lim | H04L 27/2649 375/302 |

FOREIGN PATENT DOCUMENTS

| | | | |
|---|---|---|---|
| GB | 2 328 319 | A | 2/1999 |
| JP | 2009-100158 | A | 5/2009 |
| JP | 2011-55036 | A | 3/2011 |

OTHER PUBLICATIONS

Ding, Yuan & Fusco, Vincent. Loading artificial magnetic conductor and artificial magnetic conductor absorber with negative impedance convertor elements. Microwave and Optical Technology Letters (Year: 2012).*

Shanshan Wang, Jinsong Gao and Xiaoguo Feng, "Composite-structure frequency selective surface with tripole elements," 2008 8th International Symposium on Antennas, Propagation and EM Theory, Kunming, pp. 86-89 (Year: 2008).*

Chinese-language Office Action issued in counterpart Chinese Application No. 201580029540.5 dated May 27, 2019 with English translation (19 pages).

Mantash et al., "Investigation of Flexible Textile Antennas and AMC Reflectors", International Journal of Antennas and Propagation, Dec. 31, 2012, pp. 1-10, vol. 2012, Hindawi Publishing Corporation (10 pages).

Hosseini et al., "Characteristics Estimation for Jerusalem Cross-Based Artificial Magnetic Conductors", IEEE Antennas and Wireless Propagation Letters, Dec. 31, 2008, pp. 58-61, vol. 7 (four pages).

Japanese-language Office Action issued in counterpart Japanese Application No. 2014-115956 dated Feb. 6, 2018 with unverified English translation (six pages).

Chinese-language Office Action issued in counterpart Chinese Application No. 201580029540.5 dated Nov. 21, 2018 with English translation (18 pages).

AMC-EBG, "Chapter II Characteristics and Research Methods of EBG Structure," Nov. 15, 2013 (12 pages).

Unverified English-language translation of previously submitted document B2 (ten (10) pages).

H.M. El-Maghrabi et al., "Parametric Study of Planar Artificial Magnetic Conductor Surface," Proceedings of the Twenty Third National Radio Science Conference, Mar. 2006, pp. 1-8, vol. 0.

K. Agarwal et al., "Unidirectional Wideband Circularly Polarized Aperture Antennas Backed with Artificial Magnetic Conductor Reflectors," IET Microwaves, Antennas and Propagation, 2013, pp. 338-346, vol. 7, No. 5.

Y. Kawakami et al., "Low-Profile Design of a Metasurface Considering FSS Filtering Characteristics," The Institute of Electronics, Information, and Communication Engineers, Feb. 2012, pp. 477-483, vol. E95-B, No. 2.

Y. Murakami et al., "Bandwidth Characteristics of Artificial Magnetic Conductor with Dielectric Substrate," The Institute of Electronics, Information, and Communication Engineers, 2011, with English-language abstract (four (4) pages).

H. Shinoda, "Speed of Light Network Which is Formed on Surface of Material," 2007 (with partial English-language translation) (seven (7) pages).

Y. Murakami et al., "Low-Profile Design of Loop Type AMC with Dielectric Substrate," The Institute of Electronics, Information, and Communication Engineers, 2010 (four (4) pages).

English-language translation of document C2 (Japanese-language Written Opinion (PCT/ISA/237) issued in PCT Application No. PCT/JP2015/066252 dated Aug. 25, 2015) previously filed on Dec. 2, 2016 (five (5) pages).

International Search Report (PCT/ISA/210) issued in PCT Application No. PCT/JP2015/066252 dated Aug. 25, 2015 with English-language translation (five (5) pages).

Japanese-language Written Opinion (PCT/ISA/237) issued in PCT Application No. PCT/JP2015/066252 dated Aug. 25, 2015 (four (4) pages).

* cited by examiner

ARTIFICIAL MAGNET CONDUCTOR, ANTENNA REFLECTOR, AND METHOD FOR CALCULATING THICKNESS OF DIELECTRIC MEDIUM

TECHNICAL FIELD

The present invention relates to an artificial magnet conductor which reflects an electromagnetic wave in a specific frequency, an antenna reflector which uses the artificial magnet conductor, and a method for calculating a thickness of a dielectric medium of the artificial magnet conductor.

BACKGROUND ART

In the related art, it is not considered that an antenna for a broad bandwidth is used in a situation in which directivity is required. However, recently, the situation in which a broadband antenna with directivity is required has increased. In order for the broadband antenna to have an appropriate directivity, a reflection plate which reflects an electromagnetic wave is generally used. The reflection plate is provided in a location which is generally separated from the antenna by $\lambda/4$ ($\lambda$ is a wavelength of an electromagnetic wave which is used) (refer to, for example, Patent Literature 1). That is, when an antenna element and a ground element (ground plate) are combined together to operate, for example, in a case where antenna characteristics such as emission efficiency or gain increase, setting of a gap between the antenna element and the ground plate is very important.

Specifically, if a material of the ground element is assumed to be a complete electric conductor, a condition for obtaining the best antenna characteristics is that a gap between the antenna element and the ground element has a length of a quarter of a wavelength of a wave which is used. In order to satisfy the condition, the antenna has a limitation of minimizing a size thereof.

Accordingly, a low profile antenna which employs a structure of an artificial magnet conductor that is called an electromagnetic band gap (EBG) structure is proposed. That is, the EBG structure is a structure in which unit cell patterns of a square shorter than an emission wavelength of an antenna are arranged in a matrix. The unit cell patterns formed of a metal are formed on a surface of a dielectric substrate which configures the artificial magnet conductor, a ground metal plate is formed on a rear surface of the dielectric substrate, and an artificial magnet conductor which is close to a complete magnetic body and has high surface impedance is formed (refer to, for example, Patent Literature 2).

As described above, a method for designing an artificial magnet conductor which reflects a predetermined frequency by mainly using the artificial magnet conductor for the reflection plate is disclosed (refer to, for example, Non Patent Literature 1 and Non Patent Literature 2).

Non Patent Literature 1 discloses a method for appropriately designing a distance between a frequency selective surface (FSS) and a ground plate, in an artificial magnet conductor in which there is air ($\varepsilon r=1$) between the FSS and the ground plate.

Non Patent Literature 2 describes design of an artificial magnet conductor according to an FSS which uses a dielectric layer.

CITATION LIST

Patent Literature

Patent Literature 1: JP-A-2009-100158
Patent Literature 2: JP-A-2011-055036

Non Patent Literature

Non Patent Literature 1: Yuki KAWAKAMI, Toshikazu HORI, Mitoshi FUJIMOTO, Ryo YAM AGUCHI, Keizo CHO: Low-Profile Design of Metasurface Considering FSS Filtering Characteristics, IEICE TRANS. COMMUN., VOL. E95-B, NO. 2 Feb. 2012

Non Patent Literature 2: Yasutaka MURAKAMI, Toshikazu HORI, Yuki KAWAKAMI, Mitoshi FUJIMOTO, Ryo YAMAGUCHI, Keizo CHO: Bandwidth Characteristics of Artificial magnet conductor Which Use Dielectric Layer, IEICE, A•P2010-91, November 2010

SUMMARY OF INVENTION

Technical Problem

However, each of Non Patent Literature 1 and Non Patent Literature 2 has a problem in which, although a reflection plate is actually designed by using an artificial magnet conductor using a described physical model, frequency characteristics of a designed reflection plate do not coincide with frequency characteristics of the reflection plate which is actually produced, and thus, accuracy of reflection frequency characteristics decreases. Patent Literature 1 also has the problem in which the frequency characteristics of the designed reflection plate do not coincide with the frequency characteristics of the actually produced reflection plate, and Non Patent Literature 1 and Non Patent Literature 2 have the same problem.

The present invention is made in view of the situations, and provides an artificial magnet conductor with frequency characteristics which are closer to frequency characteristics of a design value and has high accuracy, compared to the related art, an antenna reflector which uses the artificial magnet conductor, and a method for calculating a thickness of a dielectric medium of the artificial magnet conductor.

Solution to Problem

In order to achieve the problem as mentioned above, an artificial magnet conductor according to an aspect of the present invention includes: a dielectric medium; basic cells, each being formed on a side of a front surface of the dielectric medium, and including a conductive patch pattern and a conductive loop pattern that is formed with a predetermined gap with the conductive patch pattern; a frequency selective surface on which the basic cells are periodically arranged on the front surface of the dielectric medium; and a conductive layer that is formed on a side of a rear surface of the dielectric medium, and a phase change from an incident wave to a reflected wave with respect to the dielectric medium is set as an addition value in which a first phase change in the gap is added to a second phase change between the basic cell of the dielectric medium and the conductive layer, and a thickness of the dielectric medium is set based on the addition value.

In the artificial magnet conductor according to an aspect of the present invention, the dielectric medium may be a dielectric substrate.

In the artificial magnet conductor according to an aspect of the present invention, the thickness of the dielectric medium may be set by a predetermined expression using the addition value.

In the artificial magnet conductor according to an aspect of the present invention, the addition value may be an addition phase change amount in which the second phase change which is a phase rotation amount is added to the first phase change caused by capacitance which is formed by the gap.

In the artificial magnet conductor according to an aspect of the present invention, the predetermined expression may be an expression that subtracts the first phase change from a phase change amount which is obtained based on an S parameter of the frequency selective surface and is required for the dielectric medium, calculates the second phase change which is obtained as the subtraction results, and calculates the thickness of the dielectric medium from the second phase change.

In the artificial magnet conductor according to an aspect of the present invention, the frequency selective surface may be formed such that one of the conductive patch pattern and the conductive loop pattern has inductive reactance, and the other has capacitive reactance, at a predetermined frequency bandwidth.

In the artificial magnet conductor according to an aspect of the present invention, the thickness of the dielectric medium may be set such that the artificial magnet conductor has frequency characteristics corresponding to a plurality of frequencies, change curves of a dielectric thickness and a phase in each of the plurality of frequencies are obtained, and the phase is within ±45% of the entirety of the plurality of frequencies.

In the artificial magnet conductor according to an aspect of the present invention, the thickness of the dielectric medium that is determined by the predetermined expression may be greater than a distance of the gap when the thickness is calculated.

In the artificial magnet conductor according to an aspect of the present invention, the conductive patch pattern may be formed in a polygon, and the frequency characteristics of the frequency selective surface may be adjusted by further increasing the number of apexes by cutting regions of apex portions of the polygon in a direction perpendicular to a line connecting the apexes to a center of the polygon.

In an antenna reflector according to an aspect of the present invention, the artificial magnet conductor is used as a reflection plate.

In the antenna reflector according to an aspect of the present invention, the artificial magnet conductor may be provided to be detachable.

An aspect of the present invention provides a method for calculating a thickness of a dielectric medium of an artificial magnet conductor including a dielectric medium; basic cells, each being formed on a side of a front surface of the dielectric medium, and including a conductive patch pattern and a conductive loop pattern that is formed with a predetermined gap with the conductive patch pattern; a frequency selective surface on which the basic cells are periodically arranged on the front surface of the dielectric medium; and a conductive layer that is formed on a side of a rear surface of the dielectric medium, the method including: setting a phase change from an incident wave to a reflected wave with respect to the dielectric medium, as an addition value in which a first phase change in the gap is added to a second phase change between the basic cell of the dielectric medium and the conductive layer; and calculating the thickness of the dielectric medium based on the addition value.

Advantageous Effects of Invention

As described above, according to the present invention, a phase change from an incident wave to a reflected wave with respect to a dielectric medium is set as an addition value in which a first phase change in the gap is added to a second phase change between basic cell and a ground plate in the dielectric medium, a thickness of the dielectric medium is obtained to be produced by inserting the addition value into a predetermined expression, and thus, it is possible to obtain an accurate thickness of the dielectric medium corresponding to the frequency characteristics, and to configure an artificial magnet conductor having frequency characteristics closer to frequency characteristics of a design value, compared to the related art.

DESCRIPTION OF EMBODIMENTS

Hereinafter, an embodiment of the present invention will be described with reference to the drawings.

Figure 1:
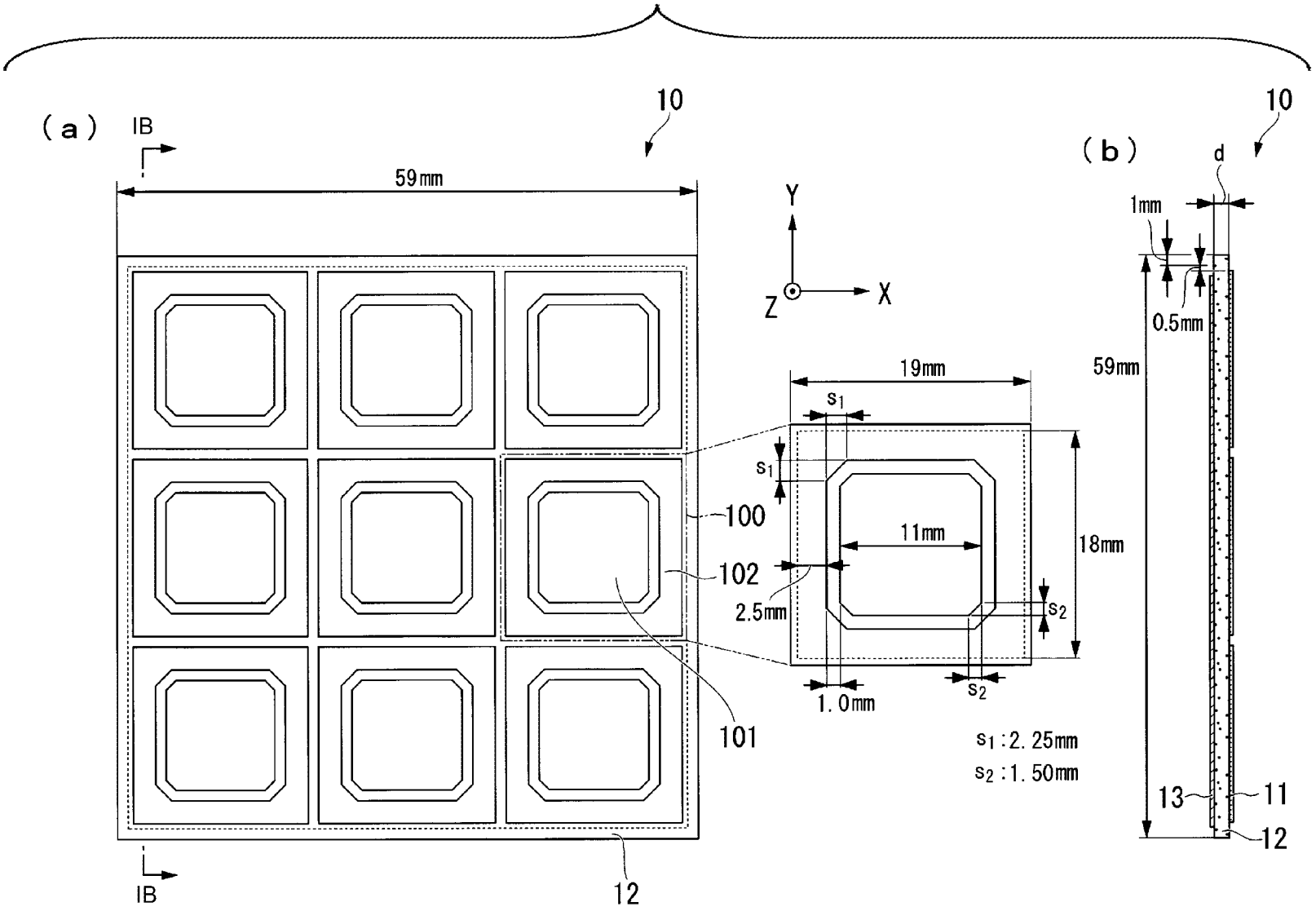
FIG. 1 illustrates a configuration example of an artificial magnet conductor (metamaterial) according to the present embodiment.

FIG. 1 illustrates a configuration example of an artificial magnet conductor (metamaterial) according to the present embodiment. Dimension of the present embodiment is just an example, and is for making electromagnetic waves with frequencies of a 2.4 GHz bandwidth and a 5 GHz bandwidth pass through, as will be described below. In a case where other frequencies pass through, dimension of each unit naturally changes depending upon a target frequency. FIG. 1 specifies a configuration of FIG. 20 which is a conceptual view of a basic configuration of an artificial magnet conductor according to the present invention, in accordance with the embodiment which will be described below.

FIG. 1(*a*) illustrates a plan view of the artificial magnet conductor. As illustrated in FIG. 1(*a*), a basic cell 100 is configured with a patch 101, and a loop 102 which is formed to surround the patch 101. The artificial magnet conductor (metamaterial) 10 has a surface on which the basic cells 100, each side having a length of 19 mm, are periodically arranged in a matrix with an interval (1.0 mm in the present embodiment). The basic cells 100 may be obliquely arranged. In the present embodiment, the artificial magnet conductor 10 is configured with nine basic cells 100 of 3 (row)×3 (column) as an example, and has a square, each side having a length of 59 mm. The artificial magnet conductor 10 functions with characteristics which are set, if the basic cells 100 have the number of arrays of 2×2 or more. The patch 101 is a pattern (patch pattern) which is formed of a conductor layer with a predetermined thickness, such as a metal, and has, for example, an octagon which is formed by cutting apexes of the square, each side having a length of 11 mm, in a direction of a line perpendicular to a line connecting the apex to the center of the square. In addition, the patches 101 are arranged in a matrix on a surface of the dielectric substrate 12 (will be described below) and are periodically arranged with a predetermined distance to other patches 101 adjacent to each other. The loops 102 are formed to surround outer circumferences of the patches 101 on the same surface as the patch 101, and have a pattern (loop pattern) which is formed of a layer of a conductor (conductor layer having the same shape as the patch 101) with a predetermined width. Here, the loop 102 has a square, each side having a length of 18 mm, and there is a gap of predetermined distance (1.0 mm in the present embodiment) between a side of an inner circumference of the loop and a side of the patch 101. The loop 102 is formed to surround the patch 101, the inner circumference of the loop corresponds to an outer circumference of the patch 101, and the loop has a gap of the predetermined distance with the patch.

FIG. 1(*b*) is a cross-sectional view of the artificial magnet conductor taken along line 1B-1B of FIG. 1(*a*). A frequency selective surface (FSS) 11 is formed on a rear surface of a surface on which a ground plate 13 is formed in the dielectric substrate 12. In addition, FSS 11 is a surface layer of the artificial magnet conductor 10 which is configured with the respective patterns of the patch 101 and the loop 102. The dielectric substrate 12 is a substrate of dielectric substance with a relative dielectric constant $\varepsilon_r$ and a thickness t. The ground plate 13 is a ground plate (ground surface) which is formed of a conductor such as a metal. Generally, the artificial magnet conductor 10 which is used as a reflection plate with a predetermined frequency is produced by adjusting each of filter characteristics of FSS 11 and a thickness d of the dielectric substrate 12.

Figure 2:
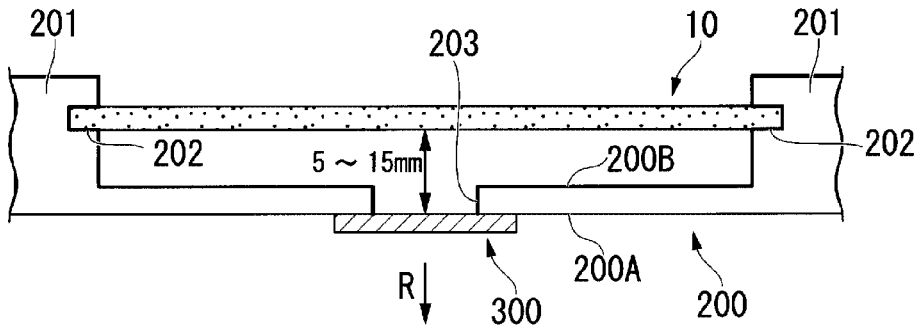
FIG. 2 is a conceptual view illustrating a configuration example of a reflection plate for antenna which uses the artificial magnet conductor according to the present embodiment.

FIG. 2 is a conceptual view illustrating a configuration example of an antenna device which uses the artificial magnet conductor 10 of FIG. 1 as a reflection plate. FIG. 2 is a view that is viewed from a side of the antenna device. In a supporting body 200, fixing walls 201 of a protrusion shape are formed perpendicularly to a surface 200A of the supporting body 200 so as to face each other on a surface 200B opposite to the surface 200A of the supporting body 200. Slits 202 in which depth directions of grooves are parallel to the surface 200A are provided on surfaces of the fixing walls 201 which face each other. End portions of the artificial magnet conductor 10 which is used as a reflector (reflection plate) are inserted into the slits 202, and the artificial magnet conductor 10 is fixed to the supporting body 200.

In addition, an opening 203 is formed in a central portion of the supporting body 200, and an antenna substrate 300 is disposed on the surface 200A to cover the opening 203. A distance between a surface of the antenna substrate 300 and the surface of the artificial magnet conductor 10 which face each other is set to, for example, 5 mm to 15 mm. The distance between the surfaces of the antenna substrate 300 and the artificial magnet conductor 10 which face each other is set by directivity of the antenna device. Here, in the antenna substrate 300 and the artificial magnet conductor 10, a surface from which an electromagnetic wave is emitted and a surface which emits an electromagnetic wave are disposed in parallel to each other. In addition, a surface, which faces the antenna substrate 300, of the artificial magnet conductor 10 is a surface on which the FSS 11 is formed. In addition, the electromagnetic wave which is emitted from the antenna substrate 300 is reflected by the artificial magnet conductor 10 and is emitted from the antenna device in an R direction.

Figure 3:
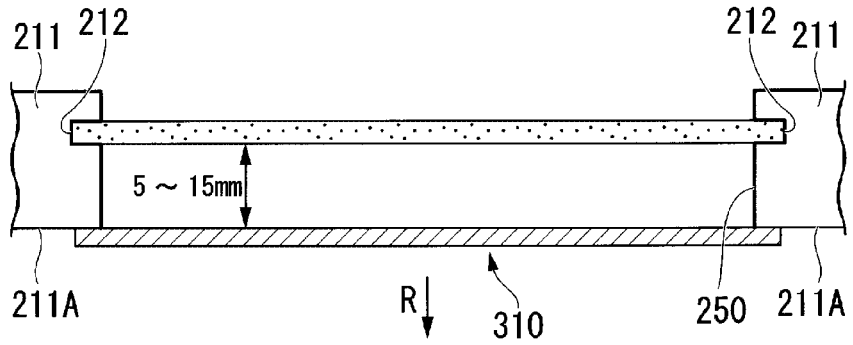
FIG. 3 is a conceptual view illustrating another configuration example of an antenna device which uses the artificial magnet conductor 10 of FIG. 1 as a reflection plate.

FIG. 3 is a conceptual view illustrating another configuration example of the antenna device which uses the artificial magnet conductor 10 of FIG. 1 as the reflection plate. FIG. 3 is a view which is viewed from a side of the antenna device. A hole 250 which passes through a supporting body 211 is formed in the supporting body 211. Slits 212 in which depth directions of grooves are parallel to surface 211A are provided on side walls, which face each other, of an inner surface of the hole 250. The end portions of the artificial magnet conductor 10 which is used as a reflection plate are inserted into the slits 212, and the artificial magnet conductor 10 is fixed to the supporting body 211. In addition, an antenna substrate 310 is disposed on the surface 211A to cover the hole 250 of the supporting body 211. A distance between a surface of the antenna substrate 310 and the surface of the artificial magnet conductor 10 which face each other is set to, for example, 5 mm to 15 mm in the same manner as in FIG. 3. The distance between the surfaces of the antenna substrate 300 and the artificial magnet conductor 10 which face each other is set by directivity of the antenna device. In addition, the surface, which faces the antenna substrate 310, of the artificial magnet conductor 10 is a surface on which the FSS 11 is formed. The electromagnetic wave which is emitted from the antenna substrate 310 is reflected by the artificial magnet conductor 10 and is emitted from the antenna device in the R direction.

<Design of Artificial Magnet Conductor>

In the present embodiment, filter characteristics of the FSS 11 on which the basic cells 100 are arranged, that is, each of S parameters $S_{11}$ (reflection coefficient), $S_{12}$ (transmission coefficient), $S_{21}$ (transmission coefficient), and $S_{22}$ (reflection coefficient), which are used for calculation in designing the artificial magnet conductor 10 hereinafter, are obtained by actual measurement or simulation. Here, the simulation is simulation of electromagnetic field•electromagnetic field analysis which uses a finite difference time domain method (FDTD) or a finite element method. Description is previously made, but in the present embodiment, perfect magnetic conductor (PMC) characteristics appear at a specific frequency, the distance d between the ground plate 13 and the FSS 11 is set, and thereby the artificial magnet conductor 10 is designed.

In the present embodiment, a design method for the artificial magnet conductor 10 with the PMC characteristics at each frequency of specific two frequencies, for example, 2.4 GHz and 5 GHz will be hereinafter described.

Figure 4:
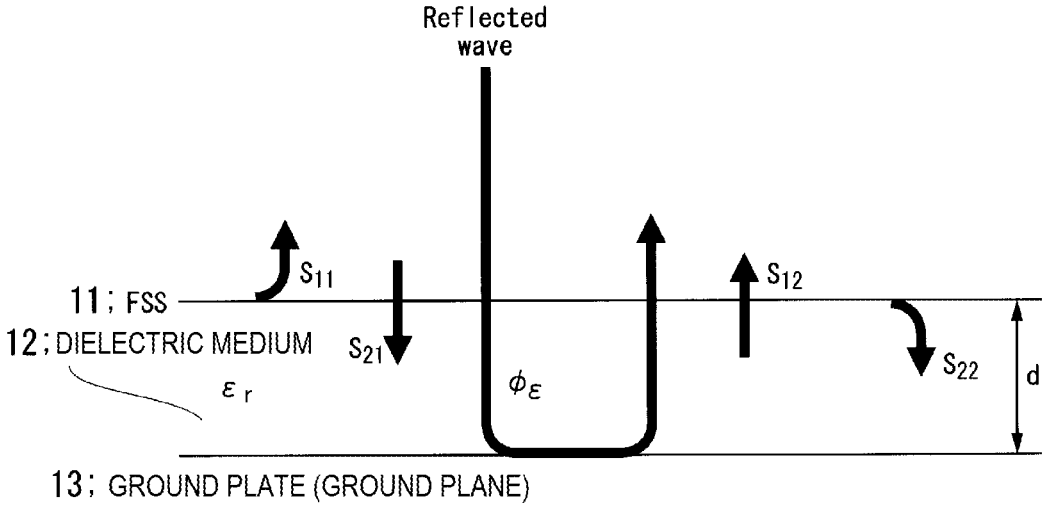
FIG. 4 is a conceptual view illustrating a relationship between a reflected wave of an incident electromagnetic wave and an S parameter of an FSS 11, in the artificial magnet conductor 10.

FIG. 4 is a conceptual view illustrating a relationship between a reflected wave of an incident electromagnetic wave and the S parameter of the FSS 11, in the artificial magnet conductor 10. In FIG. 4, the FSS 11 is formed on the front surface of the dielectric substrate 12, and the ground plate 13 is formed on the rear surface thereof. A reflection coefficient of an electromagnetic wave of the front surface of the dielectric substrate 12 on which the FSS 11 is formed is $S_{11}$, and a transmission coefficient of an electromagnetic wave which passes through the inside of the dielectric substrate 12 from the front surface is $S_{21}$. In addition, a transmission coefficient of an electromagnetic wave which is incident on the dielectric substrate 12, is reflected by the ground plate 13, and passes through the front surface, is $S_{12}$, and a reflection coefficient of an electromagnetic wave which is reflected from an interface between the FSS 11 and the dielectric substrate 12 is $S_{22}$. A basic model (Non Patent Literature 2) describes that a phase change occurs only in the phase rotation amount $\phi_\varepsilon$ (second phase change), an electric field is incident on the ground plate 13, and a reflection phase thereof becomes $-\pi$ (rad), in the dielectric substrate 12.

In addition, in the present embodiment, approximation ray theory in which logic is simple is used as a design method. By using the approximation ray theory, characteristics of an electromagnetic wave can be directly calculated by adding a full electromagnetic field to another electromagnetic wave. In the present embodiment, the approximation ray theory of the related approximation ray theory is extended by a physical model that the inventor designs, and a calculation expression which performs design of an artificial magnet conductor with more accuracy is realized, which will be described below.

Figure 5:
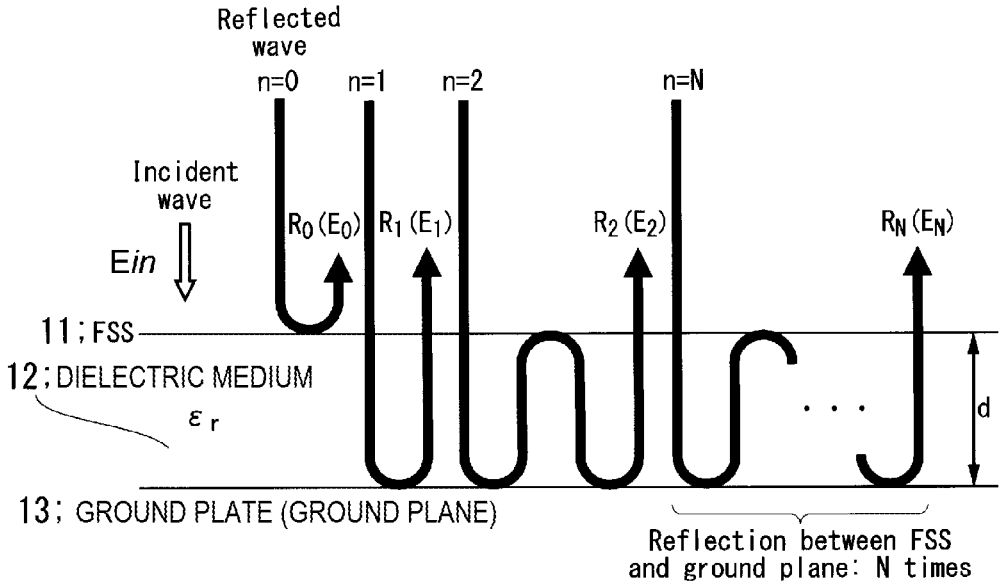
FIG. 5 is a diagram illustrating a path of the reflected wave when the electromagnetic wave is incident perpendicularly to a surface on which the FSS 11 of the artificial magnet conductor 10 is formed.

FIG. 5 is a diagram illustrating a path of the reflected wave when the electromagnetic wave (plane wave) is incident perpendicularly to a surface on which the FSS 11 of the artificial magnet conductor 10 is formed. In FIG. 5, the FSS 11 is formed on the front surface of the dielectric substrate 12, and the ground plate 13 is formed on the rear surface thereof, in the same manner as in FIG. 4. A reflected wave $R_0$ with an amplitude of $|S_{11}|$ times an amplitude of an incident electromagnetic wave is reflected by the FSS 11 of the artificial magnet conductor 10. The reflected wave $R_0$ is not reflected from an interface between the dielectric substrate 12 and the ground plate 13 even once. That is, the reflected wave $R_0$ is reflected from the interface between the dielectric substrate 12 and 13 zero times.

In addition, a transmission wave which is $|S_{21}|$ times the incident electromagnetic wave is incident on the dielectric substrate 12. The incident electromagnetic wave is reflected by the interface between the dielectric substrate 12 and the ground plate 13, and is incident on the interface between the FSS 11 and the dielectric substrate 12 again. Here, if the electromagnetic wave passes through the interface between the FSS 11 and the dielectric substrate 12, the electromagnetic wave becomes a reflected wave $R_1$. In the reflected wave $R_1$, a transmission wave which is $|S_{21}|\cdot|S_{12}|$ times the incident electromagnetic wave is emitted into the air. The reflected wave $R_1$ is reflected from the interface between the dielectric substrate 12 and the ground plate 13 once.

Meanwhile, the incident electromagnetic wave is reflected from the interface between the dielectric substrate 12 and the ground plate 13, and is reflected from the interface between the FSS 11 and the dielectric substrate 12. In addition, the electromagnetic wave is reflected from the interface between the dielectric substrate 12 and the ground plate 13 again, and is incident on the interface between the FSS 11 and the dielectric substrate 12. Here, if the electromagnetic wave passes through the interface between the FSS 11 and the dielectric substrate 12, the electromagnetic wave becomes the reflected wave $R_2$. The reflected wave $R_2$ is reflected from the interface between the dielectric substrate 12 and the ground plate 13 twice. In addition, if the electromagnetic wave which is incident on the artificial magnet conductor 10 is reflected from the interface between the dielectric substrate 12 and the ground plate 13 N times, the reflected wave becomes a reflected wave $R_N$.

In a case where the number of reflections from the interface between the dielectric substrate 12 and the ground plate 13 which are described above is N=0, 1, and 2, an electric field $E_0$ of the reflected wave $R_0$, an electric field $E_1$ of the reflected wave $R_1$, and an electric field $E_2$ of the reflected wave $R_2$ are respectively represented by Expression (1), Expression (2), and Expression (3) which are describe below. In the present embodiment, j is an imaginary unit.

[Expression 1]

$$E_0=|S_{11}|e^{j\phi_{11}} \quad (1)$$

In Expression (1), a phase $\phi_{11}$ denotes a reflection phase when the electromagnetic wave is reflected to the air, at the interface between the FSS 11 and the dielectric substrate 12. $S_{11}$ is a reflection coefficient.

[Expression 2]

$$E_1=|S_{21}||S_{12}|e^{j(\phi_{21}+\phi_{12}+2\phi_\varepsilon-\pi)} \quad (2)$$

In Expression (2), a phase $\phi_{21}$ denotes a transmission phase when the electromagnetic wave passes through the dielectric substrate 12 side from the FSS 11 side, at the interface between the FSS 11 and the dielectric substrate 12. In addition, a phase $\phi_{12}$ denotes a transmission phase when the electromagnetic wave passes through the FSS 11 side from the dielectric substrate 12 side, at the interface between the FSS 11 and the dielectric substrate 12. The phase rotation amount $\phi_\varepsilon$ is a phase rotation amount between the FSS 11 and the dielectric substrate 12. $S_{21}$ and $S_{12}$ are transmission coefficients. In addition, the phase change amount $\phi_\varepsilon$ is a phase rotation amount which is generated in accordance with a distance between the FSS 11 and the dielectric substrate 12, that is, the thickness d of the dielectric substrate 12.

[Expression 3]

$$E_2=|S_{21}||S_{12}||S_{22}|e^{j(\phi_{22}+\phi_{21}+\phi_{12}+4\phi_\varepsilon-2\pi)} \quad (3)$$

In Expression (3), a phase $\phi_{22}$ denotes a reflection phase when the electromagnetic wave is reflected to the dielectric substrate 12 side, at the interface between the FSS 11 and the dielectric substrate 12. In addition, a phase $\phi_{21}$ denotes a transmission phase when the electromagnetic wave passes through the dielectric substrate 12 side from the FSS 11 side, at the interface between the FSS 11 and the dielectric substrate 12. A phase $\phi_{12}$ denotes a transmission phase when the electromagnetic wave passes through the FSS 11 side from the dielectric substrate 12 side, at the interface between the FSS 11 and the dielectric substrate 12. The phase change amount $\phi_\varepsilon$ is a phase rotation amount between the FSS 11 and the dielectric substrate 12. $S_{21}$ and $S_{12}$ are transmission coefficients. $S_{11}$ and $S_{22}$ are reflection coefficients.

In addition, in a case where the number of reflections from the interface between the dielectric substrate 12 and the ground plate 13 is one or more, a combined electric field of the entire reflected waves from the reflected wave $R_0$ to the reflected wave $R_N$ is represented as geometric series which are represented by a first term $E_1$ and a geometric ratio r. The geometric ratio r is represented by following Expression (4).

[Expression 4]

$$r=|S_{22}|e^{j(\phi_{22}+2\phi_\varepsilon-\pi)} \quad (4)$$

By using the geometric ratio r of Expression (4) described above, a combined electric field $E_{total}$ of the entire reflected waves from the reflected wave $R_0$ to the reflected wave $R_N$ is represented by following Expression (5).

[Expression 5]

$$E_{total} = E_0 + \sum_{n=1}^{N} E_n = E_0 + \frac{E_1(1-r^N)}{1-r} \quad (5)$$

In Expression (5), N becomes ∞ (infinity). Thereby, $r^N$ becomes zero, and Expression (5) can be represented by following Expression (6).

[Expression 6]

$$E_{total} = E_0 + \frac{E_1}{1-r} \quad (6)$$

Here, a declination angle of the electric field $E_{total}$ becomes a reflection phase $\phi_{FSS}$ of the artificial magnet conductor 10.

Figure 6:
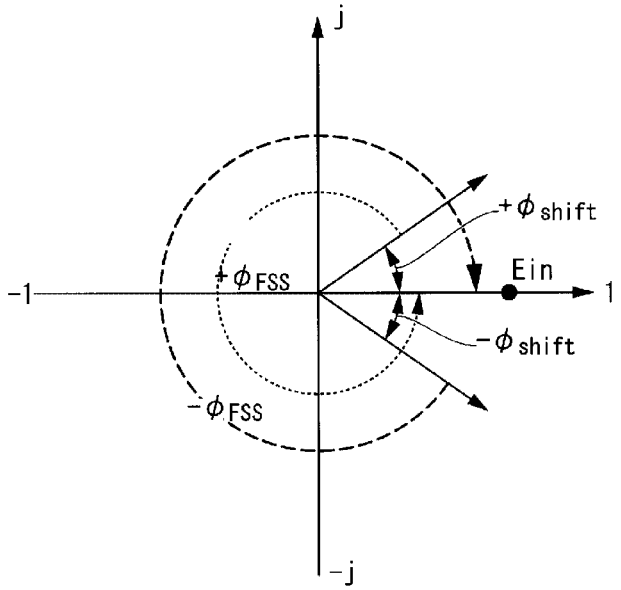
FIG. 6 is a diagram illustrating a correspondence relationship, which is denoted on a complex plane, between a phase rotation amount and a reflection phase, with respect to a surface of an FSS 11, in a state where an electric field of an incident electromagnetic wave is referred to as $E_{in}$.

FIG. 6 is a diagram illustrating a correspondence relationship, which is denoted on a complex plane, between the reflection phase $\phi_{FSS}$ and the phase rotation amount $\phi_{shift}$, with respect to the front surface of an FSS 11, in a state where an electric field of an incident electromagnetic wave is referred to as $E_{in}$. A vertical axis is an imaginary number axis (Im ($E_{total}$)) and a horizontal axis is a real number axis (Rm ($E_{total}$)).

If the electromagnetic field $E_{in}$ is one on the complex plane, when the declination angle of the electric field $E_{total}$ is zero, the declination angle of the electromagnetic field coincides with the phase rotation amount $\phi_{FSS}$. At this time, the phase rotation amount $\phi_{shift}$ becomes zero, and the artificial magnet conductor 10 denotes characteristics of a complete magnetic conductor.

In addition, as described above, the phase rotation amount $\phi_{shift}$ has positive and negative values corresponding to a rotation direction of the reflection phase $\phi_{FSS}$, as illustrated in FIG. 6. Hence, when an imaginary portion $I_m$ ($E_{total}$)=0, a real portion $R_e$ ($E_{total}$)>0, the phase rotation amount $\phi_{shift}$ becomes zero. In addition, it can be seen that, when the number of rotations N is large enough, the real portion $R_e$ ($E_{total}$) substantially has a positive value, and thus, $E_{total}$=0 as condition in which arg ($E_{total}$)=0.

If Expression (1), Expression (2), Expression (3), and $E_{total}$=0 are inserted into Expression (6), following Expression (7) is obtained.

[Expression 7]

$$2\phi_\varepsilon = \arg\left(\frac{|S_{11}|e^{j\phi_{11}}}{|S_{21}||S_{12}|e^{j(\phi_{21}+\phi_{12})} - |S_{11}||S_{22}|e^{j(\phi_{11}+\phi_{22})}}\right) \quad (7)$$

Accordingly, the phase rotation amount $\phi_\varepsilon$ incident on the dielectric substrate 12 can be represented by following Expression (8).

[Expression 8]

$$\phi_\varepsilon = \pm\frac{1}{2}\arg\left(\frac{|S_{11}|e^{j\phi_{11}}}{|S_{21}||S_{12}|e^{j(\phi_{21}+\phi_{12})} - |S_{11}||S_{22}|e^{j(\phi_{11}+\phi_{22})}}\right) \quad (8)$$

In a case of the aforementioned physical model (that is, basic model), the calculated phase rotation amount $\phi_\varepsilon$ corresponds to the phase rotation amount $\phi_{shift}$. The phase change amount $\phi_\varepsilon$ (that is, the phase rotation amount $\phi_{shift}$) required for the dielectric substrate 12 is obtained based on the S parameters ($S_{11}$, $S_{12}$, $S_{21}$, and $S_{22}$) of the FSS 11 in FIG. 4.

Figure 7:
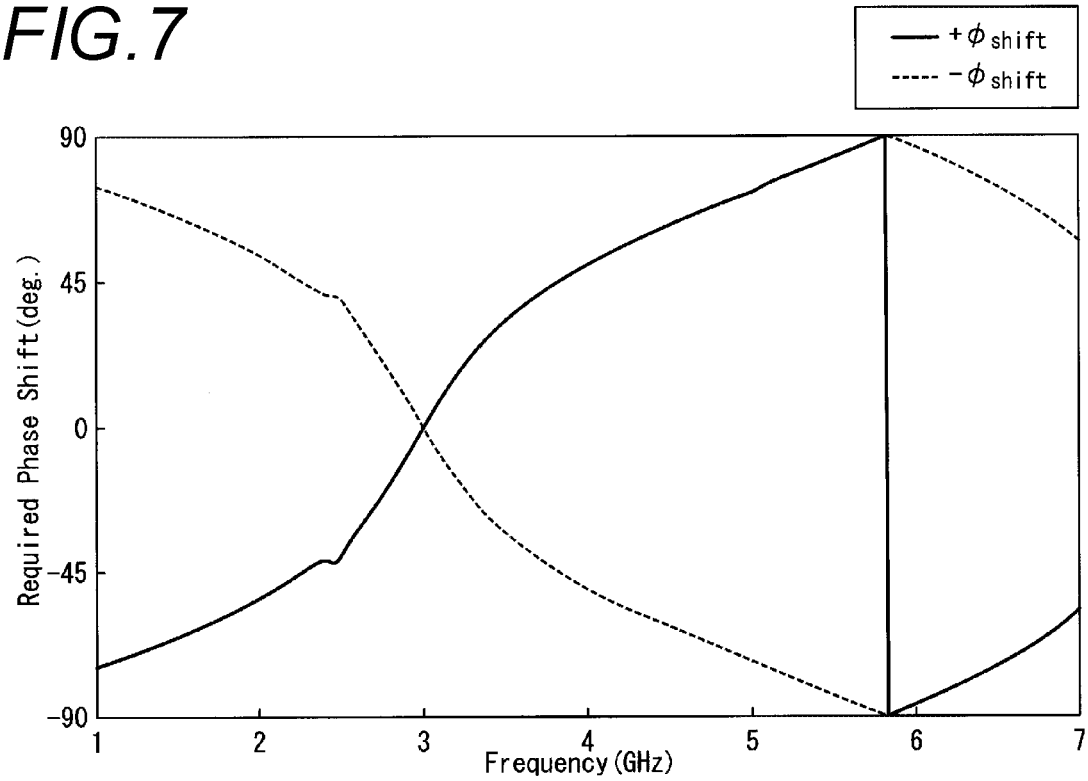
FIG. 7 is a graph illustrating a correspondence relationship between a frequency, which is obtained by Expression (8), of the electromagnetic wave that is incident on the artificial magnet conductor 10, and a phase change amount $\phi_\varepsilon$ of a dielectric substrate 12.

FIG. 7 is a graph illustrating a correspondence relationship between a frequency, which is obtained by Expression (8), of the electromagnetic wave that is incident on the artificial magnet conductor 10 and the phase change amount $\phi_\varepsilon$ of the dielectric substrate 12. In FIG. 7, a vertical axis denotes a reflection phase change amount (Required Phase Shift, unit is deg.), a horizontal axis denotes a frequency (Frequency, unit is GHz) of the incident electromagnetic wave. As illustrated by the graph of FIG. 7, plus and minus phase change amounts $\phi_\varepsilon$ are all "0" at 3 GHz.

In addition, the phase change amount $\phi_\varepsilon$ of the dielectric substrate 12 can be represented by following Expression (9).

[Expression 9]

$$\phi_\varepsilon = -\frac{2\pi f d\sqrt{\varepsilon_{eff}}}{c} \tag{9}$$

In Expression (9), f denotes a frequency of an incident electromagnetic wave, d denotes a thickness of the dielectric substrate 12, $\varepsilon_{eff}$ denotes an effective relative dielectric constant, and c denotes speed of light.

Here, the effective relative dielectric constant $\varepsilon_{eff}$ can be represented by following Expression (10). In Expression (10), $\varepsilon_r$ denotes relative dielectric constant, W denotes a width of a pattern of the patch 101, d denotes a thickness of the dielectric substrate 12, and t denotes a thickness of each of the patch 101 and the loop 102.

[Expression 10]

$$\varepsilon_{reff} = \frac{\varepsilon_r + 1}{2} + \frac{\varepsilon_r - 1}{2} F\left(\frac{W}{d}\right) - \frac{\varepsilon_r - 1}{4.6} \frac{\frac{t}{d}}{\sqrt{\frac{W}{d}}} \tag{10}$$

In addition, F(W/d) in Expression (10) is represented by following Expression (11).

[Expression 11]

$$F\left(\frac{W}{d}\right) = \frac{1}{\sqrt{1 + 12\frac{d}{W}}} \tag{11}$$

$$\frac{W}{d} \geq 1$$

However, it is confirmed that the phase change amount $\phi_\varepsilon$ which is obtained by calculation of Expression (6), Expression (9), Expression (10), and Expression (11) which are described above does not coincide with the results of the electromagnetic field simulation obtained by using a finite element method. Hence, actually, it is considered that a phase change more than the phase change amount which is represented by Expression (9) occurs. Accordingly, as described below, study of a physical model of a reflection system of the electromagnetic wave in the artificial magnet conductor 10 has been performed.

Here, the basic cell 100 of the FSS 11 according to the present embodiment is configured with each of the patch 101 and the loop 102, as illustrated in FIG. 1. The patch 101 of the basic cell 100 is formed in an inner side of the loop 102, an area thereof is AP (=116.5 mm$^2$), and an outer circumference thereof is $L_p$ (=40.5 mm). In the loop 102 of the basic cell 100, an area is AL (=165.125 mm$^2$), and an outer circumference is An $L_1$ (=72 mm). Here, if a wavelength shortening rate $\eta$ is considered, a parallel resonance frequency $f_P$ of a structure of the patch 101 is represented by Expression (12), and a parallel resonance frequency $f_L$ of a structure of the loop 102 is represented by Expression (13). In Expression (12) and Expression (13), c is speed of light, and c=3×10$^8$ m/s.

[Expression 12]

$$f_P = \frac{c \times \eta}{L_P} \tag{12}$$

[Expression 13]

$$f_L = \frac{c \times \eta}{L_l} \tag{13}$$

The wavelength shortening rate $\eta$ of Expression (12) and Expression (13) is obtained by following Expression (14).

[Expression 14]

$$\eta = \frac{1}{\sqrt{\varepsilon_{reff}}} \tag{14}$$

If the width w of the pattern of the patch 101 is 18 mm and the thickness t of the pattern of the patch 101 is 0.035 mm, the effective relative dielectric constant $\varepsilon_{eff}$ which is obtained by Expression (10) and Expression (11) is 4.05. The wavelength shortening rate $\eta$ is calculated by inserting the effective relative dielectric constant $\varepsilon_{eff}$ into Expression (14). In addition, each of the parallel resonance frequency $f_P$ and the parallel resonance frequency $f_L$ is obtained by inserting the calculation results into each of Expression (12) and Expression (13). As a result, the parallel resonance frequency $f_P$ of 3.68 GHz is obtained from Expression (12), and the parallel resonance frequency $f_L$ is obtained from Expression (13). As a result, the parallel resonance frequency $f_P$ of 2.07 GHz is obtained from Expression (12).

Here, in a case where a frequency of an incident electromagnetic wave is lower than the parallel resonance frequency $f_P$ of the patch 101, the patch 101 has characteristics of capacitive reactance. In the same manner, in a case where the frequency of the incident electromagnetic wave is lower than the parallel resonance frequency $f_L$ of the loop 102, the loop 102 has characteristics of capacitive reactance. In addition, in a case where the frequency of the incident electromagnetic wave is higher than the parallel resonance frequency $f_P$ of the patch 101 and is equal to or lower than double of the parallel resonance frequency $f_P$, the patch 101 becomes inductive reactance. In the same manner, in a case where the frequency of the incident electromagnetic wave is higher than the parallel resonance frequency $f_L$ of the loop 102 and is equal to or lower than double of the parallel resonance frequency $f_L$, the loop 102 becomes inductive reactance.

In addition, in a case where the frequency of the incident electromagnetic wave is equal to or higher than double of the parallel resonance frequency $f_P$ of the patch 101 and is equal to or lower than triple of the parallel resonance frequency $f_P$, the patch 101 becomes capacitive reactance. In the same manner, in a case where the frequency of the incident electromagnetic wave is equal to or higher than double of the parallel resonance frequency $f_L$ of the loop 102 and is equal to or lower than triple of the parallel resonance frequency $f_L$, the loop 102 becomes capacitive reactance.

That is, a relationship in a case where the patch 101 has the characteristics of capacitive reactance can be represented by the following expression, if the frequency of the incident electromagnetic wave is referred to as f.

$$f<f_P, 2f_P<f<3f_P$$

In the same manner, a relationship in a case where the loop 102 has the characteristics of capacitive reactance can be represented by the following expression, if the frequency of the incident electromagnetic wave is referred to as f.

$$f<f_L, 2f_L<f<3f_L$$

In addition, a relationship in a case where the patch 101 has the characteristics of inductive reactance can be represented by the following expression, if the frequency of the incident electromagnetic wave is referred to as f.

$$f_P<f<2f_P$$

In the same manner, a relationship in a case where the loop 102 has the characteristics of inductive reactance can be represented by the following expression, if the frequency of the incident electromagnetic wave is referred to as f.

$$f_L<f<2f_L$$

Here, in a case where the frequency is 2.4 GHz to 2.5 GHz, the parallel resonance frequency $f_P$ is 2.07 GHz, and the parallel resonance frequency $f_P$ is 3.68 GHz. Accordingly, the patch 101 has the characteristics of capacitive reactance, and the loop 102 has the characteristics of inductive reactance.

Meanwhile, in a case where the frequency is 5 GHz to 6 GHz, the parallel resonance frequency $f_P$ is 2.07 GHz, and the parallel resonance frequency $f_P$ is 3.68 GHz. Accordingly, the patch 101 has the characteristics of inductive reactance, and the loop 102 has the characteristics of capacitive reactance.

In addition, it is known that an evanescent wave is generated on the FSS 11 with finite impedance, in a structure of a sheet shape configured by each of the FSS 11 and the ground plate 13 which have finite impedance, and the dielectric substrate 12 (for example, refer to Hiroyuki SHINODA: "Speed of Light Network Which is Formed on Surface of Material", Measurement and Control, VOL. 46, NO. 2, 2007).

The evanescent wave is generated in any one pattern of the patch 101 and the loop 102 which have characteristics of inductive reactance by the incident electromagnetic wave and is changed with respect to the other pattern having characteristics of capacitive reactance.

That is, the evanescent wave generated by the pattern of the inductive reactance is transferred from the pattern of inductive reactance to the pattern of capacitive reactance through a gap between the patterns of the patch 101 and the loop 102. In addition, the evanescent wave is incident on the dielectric substrate 12 from the pattern of the capacitive reactance. As a result, modification is not made in the basic model, but made in a physical model of a reflection system of the electromagnetic wave of the artificial magnet conductor 10, by taking into account a phase change in the gap between the patterns of the patch 101 and the loop 102.

Figure 8:
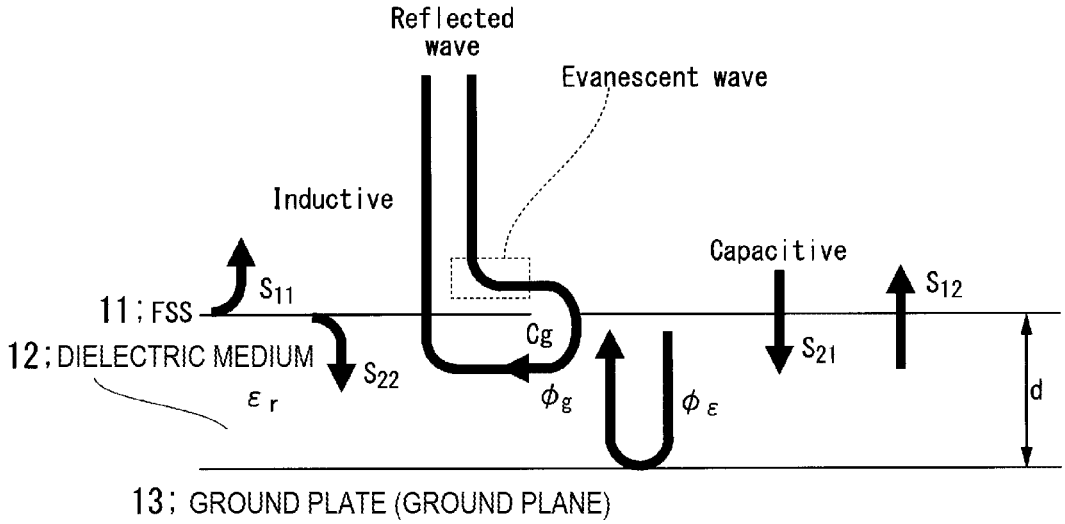
FIG. 8 is a conceptual view illustrating a relationship between the reflected wave and the S parameter of the FSS 11 in the artificial magnet conductor 10 of the electromagnetic wave which is incident by a modified physical model according to the present embodiment.

FIG. 8 is a conceptual view illustrating a relationship between the reflected wave and the S parameter of the FSS 11 in the artificial magnet conductor 10 of the electromagnetic wave which is incident by a modified physical model according to the present embodiment. In FIG. 8, the FSS 11 is formed on the front surface of the dielectric substrate 12, and the ground plate 13 is formed on the rear surface thereof. A reflection coefficient of the electromagnetic wave of the front surface on which the FSS 11 of the dielectric substrate 12 is formed is $S_{11}$, and a transmission coefficient of the electromagnetic wave which passes through the inside of the dielectric substrate 12 from the front surface thereof is $S_{21}$. In addition, a transmission coefficient of the electromagnetic wave which is incident on the dielectric substrate 12, is reflected by the ground plate 13, and passes through the front surface, is $S_{12}$, and a reflection coefficient of the electromagnetic wave which is reflected from the interface between the FSS 11 and the dielectric substrate 12 is $S_{22}$.

In addition, the evanescent wave generated in the pattern of the inductive reactance is transferred to the pattern of the capacitive reactance, and thereafter, the evanescent wave is incident on the dielectric substrate 12. Here, capacitance of a gap between (that is, between the patch 101 and the loop 102) the patterns is referred to as $C_g$. In addition, a phase change in the gap having the capacitance $C_g$ is referred to as a phase change $\phi_g$ (first phase change). It is considered that the phase change $\phi_g$ of the aforementioned evanescent wave becomes an error of the basic model. That is, it is considered that a phase change larger than the phase change amount which is represented by Expression (9) corresponds to the phase change $\phi_g$.

Figure 9:
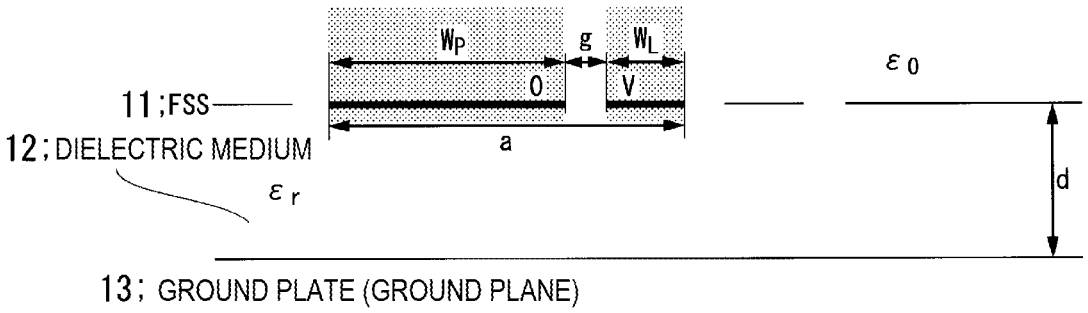
FIG. 9 is a diagram illustrating a gap between each pattern of a patch 101 and a loop 102 which configure the artificial magnet conductor 10 according to the present embodiment.

FIG. 9 is a diagram illustrating the gap between each pattern of the patch 101 and the loop 102 which configure the artificial magnet conductor 10 according to the present embodiment. In FIG. 9, the FSS 11 is formed on the front surface of the dielectric substrate 12, and the ground plate 13 is formed on the rear surface thereof. A width of the pattern of the patch 101 in the FSS 11 of the dielectric substrate 12 is $W_P$, and a width of the pattern of the loop 102 is $W_L$. In addition, a distance of a gap between the pattern of the patch 101 and the pattern of the loop 102 is g. An addition distance which is obtained by adding the width of the pattern of 101, the width of the pattern of the loop 102, and the distance g of the gap together is a. $\varepsilon_r$ is a relative dielectric constant of a dielectric substrate, and $\varepsilon_0$ is a relative dielectric constant of air. V is a potential difference between the loop 102 and the patch 101.

The capacitance $C_g$ which is generated in the gap between the pattern of the patch 101 and the pattern of the loop 102 can be represented by two-dimensional electrostatic filed distribution as described below. That is, in the physical model modified in accordance with the present embodiment, distribution $\psi$ of an electric flux between the pattern of the patch 101 and the pattern of the loop 102, that is, in the gap can be represented by following Expression (15).

[Expression 15]

$$\Psi = \mathrm{Im}\left\{\frac{\varepsilon_0(1+\varepsilon_r)V}{\pi}\cos^{-1}\left(\frac{a}{g}\right)\right\} = \frac{\varepsilon_0(1+\varepsilon_r)V}{\pi}\cosh^{-1}\left(\frac{\frac{W_P}{2}+W_L+g}{g}\right) \quad (15)$$

In Expression (15), a is the addition distance, g is a distance of the gap between each pattern of the patch 101 and the loop 102, and V is a potential difference between the loop 102 and the patch 101. In addition, $\varepsilon_r$ is a relative dielectric constant of a dielectric substrate, and $\varepsilon_0$ is a relative dielectric constant of air.

In addition, in a case where a uniform electric flux is distributed on one side (length $W_P+2W_L+2_g$) of the pattern of the loop 102, the capacitance $C_g$ of a gap between the pattern of the patch 101 and the pattern of the loop 102 is represented by following Expression (16) from C=Q/V.

[Expression 16]

$$C_g = \frac{(W_P + 2W_L + 2g)\varepsilon_0(1+\varepsilon_r)}{\pi}\cosh^{-1}\left(\frac{W_P + 2W_L + 2g}{2g}\right) \quad (16)$$

Figure 10:
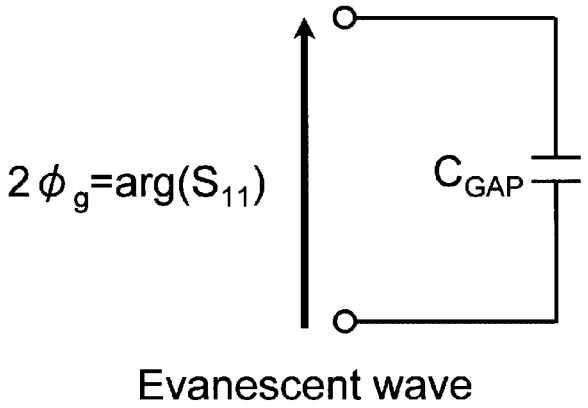
FIG. 10 is a conceptual view illustrating the phase change amount $\phi_\varepsilon$ caused by a capacitance $C_g$.

FIG. 10 is a conceptual view illustrating the phase change $\phi_g$ caused by the capacitor $C_g$. A phase change amount of the evanescent wave which is an electromagnetic wave generated by the capacitance $C_g$ is obtained from a reflection phase (reflection coefficient $S_{11}$) when the capacitance of the gap is regarded as a two-terminal network. That is, the phase change $\phi_g$ caused by the capacitance $C_g$ of the gap is obtained by arg ($S_{11}$). The phase change $\phi_g$ is obtained by each of following Expression (17) and Expression (18). Here, Expression (17) represents the reflection coefficient $S_{11}$.

[Expression 17]

$$S_{11} = \frac{1-(\omega C_g Z_o)^2}{1+(\omega C_g Z_o)^2} - j\frac{2\omega C_g Z_o}{1+(\omega C_g Z_o)^2} \quad (17)$$

[Expression 18]

$$\phi_g = \frac{1}{2}\arg(S_{11}) = \frac{1}{2}\tan^{-1}\left(\frac{-2\omega C_g Z_o}{1-(\omega C_g Z_o)^2}\right) \quad (18)$$

In each of Expression (17) and Expression (18), $Z_0$ is characteristic impedance, and ω is an angular frequency of an electromagnetic wave which is propagated. $C_g$ is capacitance of the gap between the patterns of the patch 101 and the loop 102. In each of Expression (17) and Expression (18), it is assumed that $Z_0$=50Ω

In a case where the phase change $\phi_g$ in the gap between the patterns of the patch 101 and the loop 102 is considered, the phase rotation amount $\phi_{shift}$ is obtained by following Expression (19).

[Expression 19]

$$\phi_{shift} = \phi_\varepsilon + \phi_g = -\frac{2\pi f d\sqrt{eff}}{c} + \frac{1}{2}\tan^{-1}\left(\frac{-2\omega C_g Z_o}{1-(\omega C_g Z_o)}\right) \quad (19)$$

In Expression (19), $\varepsilon_{eff}$ denotes an effective relative dielectric constant, and f denotes a frequency of an electromagnetic wave. c denotes speed of light. $Z_0$ is characteristic impedance, and ω is an angular frequency of an electromagnetic wave which is propagated. $C_g$ is capacitance of the gap between the patterns of the patch 101 and the loop 102.

Figure 11:
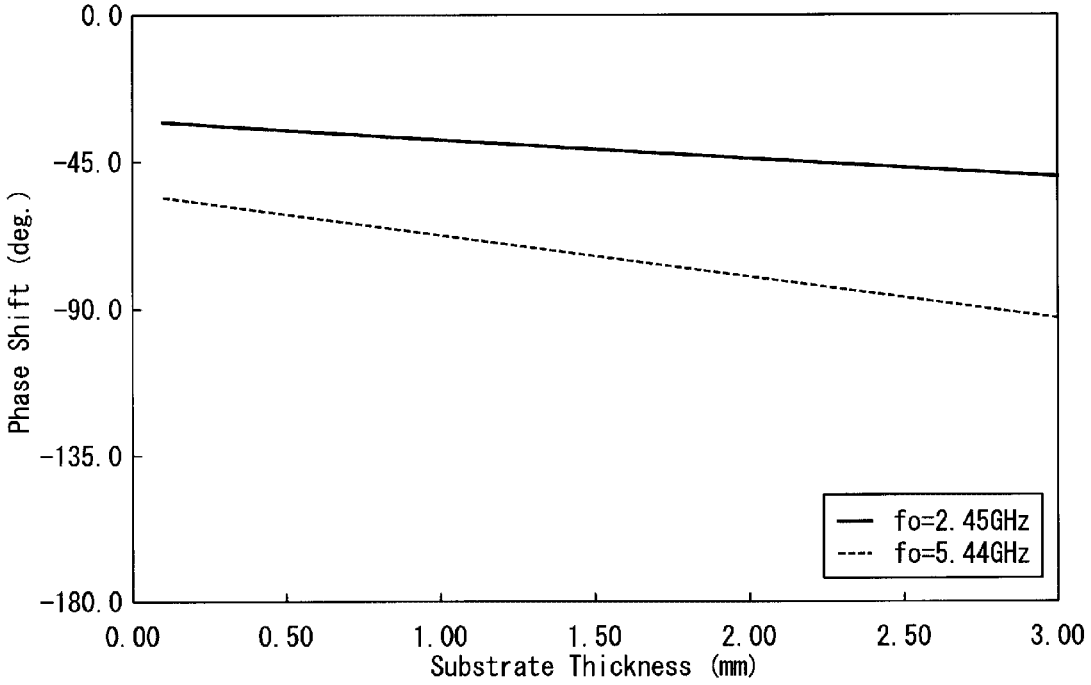
FIG. 11 is a diagram illustrating a relationship between a thickness of the dielectric substrate 12 and a phase rotation amount which are obtained by Expression (19).

FIG. 11 is a diagram illustrating a relationship between the thickness of the dielectric substrate 12 and the phase rotation amount, which are obtained by Expression (19). In FIG. 11, a vertical axis denotes the phase rotation amount $\phi_{shift}$, and a horizontal axis denotes the thickness d of the dielectric substrate 12. A solid line denotes a relationship in a case where the frequency of the electromagnetic wave is f=2.45 GHz, and a dashed line denotes a relationship (change curve) in a case where the frequency of the electromagnetic wave is f=5.44 GHz.

In addition, if Expression (6) is rewritten by using Expression (19), the electric field $E_{total}$ of a reflected wave is represented by following Expression (20).

[Expression 20]

$$E_{total} = E_0 + \frac{E_1}{1-r} = |S_{11}|e^{j\phi_{11}} + \frac{|S_{21}||S_{12}|e^{j(\phi_{21}+\phi_{12}+2\phi_\varepsilon+2\phi_g-\pi)}}{1-|S_{22}|e^{j(\phi_{22}+2\phi_g+2\phi_g-\pi)}} \quad (20)$$

In Expression (20), a reflection phase $\phi_{AMC}$ of the entire artificial magnet conductor 10 can be obtained by performing calculation, using following Expression (21).

[Expression 21]

$$\phi_{AMC} = \arg(E_{total}) = \tan^{-1}\left(\frac{\mathrm{Im}(E_{total})}{\mathrm{Re}(E_{total})}\right) \quad (21)$$

Figure 12:
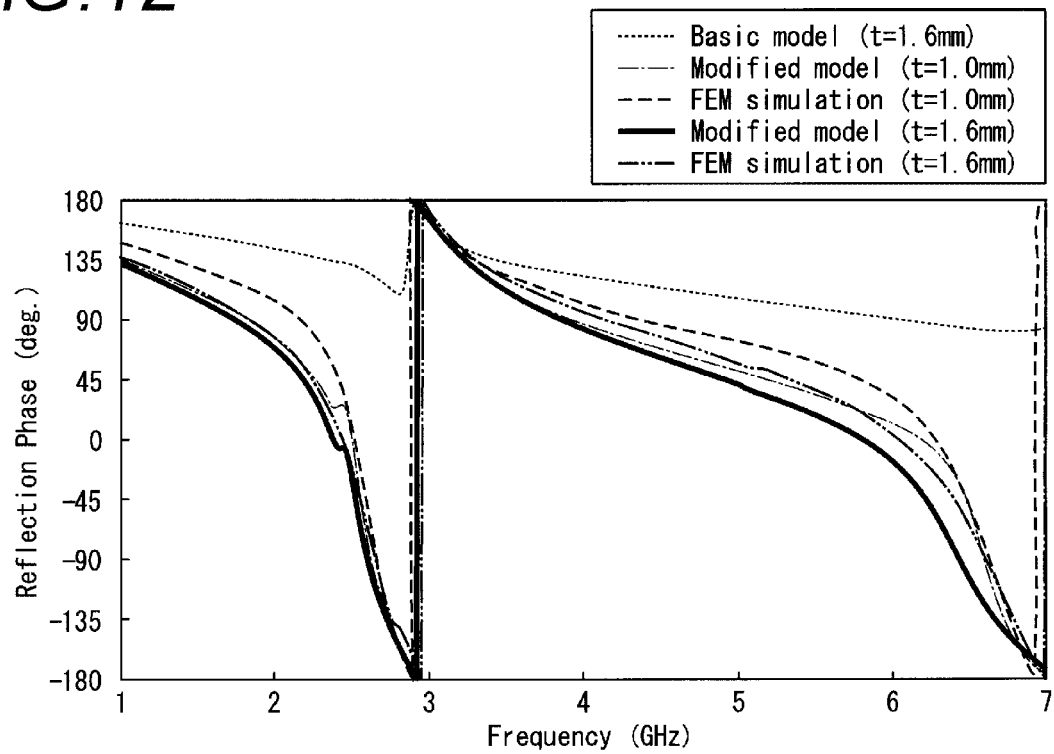
FIG. 12 is a diagram illustrating each correspondence relationship between a frequency and a reflection phase according to calculation results obtained by Expression (21) and results of electromagnetic field simulation, for comparison.

FIG. 12 is a diagram illustrating a correspondence relationship between a frequency and a reflection phase according to calculation results obtained by Expression (21) and the results of the electromagnetic field simulation, for comparison. In FIG. 12, a vertical axis denotes the reflection phase $\phi_{AMC}$, and a horizontal axis denotes a frequency of an electromagnetic wave.

As can be seen from FIG. 12, results obtained by a basic model do not substantially coincide with the results of the electromagnetic field simulation (FEM simulation). The basic model is a model in which the phase change $\phi_g$ caused by the capacitance $G_g$ of the gap is not considered but only the phase change amount $\phi_\varepsilon$ in the dielectric substrate 12 represented by Expression (9) is considered.

However, it can be seen that the results obtained by Expression (21) of the modified model according to the present embodiment exactly coincides with the results of the electric field simulation, compared with the basic model.

In Expression (21) described above, a design expression of the thickness d of the dielectric substrate 12 can be obtained by setting $E_{total}$=0 as a condition that a reflection phase is set to "0". Here, if the phase change amount $\phi_\varepsilon$ which is calculated by Expression (8) is set to the phase rotation amount $\phi_{shift}$, following Expression (22) is obtained.

[Expression 22]

$$\phi_{shift} = \pm\frac{1}{2}\arg\left(\frac{|S_{11}|e^{j\phi_{11}}}{|S_{21}||S_{12}|e^{j(\phi_{21}+\phi_{12})} - |S_{11}||S_{22}|e^{j(\phi_{11}+\phi_{22})}}\right) \quad (22)$$

In addition, following Expression (23) which obtains the thickness of the dielectric substrate 12 is obtained by inserting Expression (22) described above into Expression (19). In addition, in Expression (23), an absolute value is taken such that the required phase rotation amount $\phi_{shift}$ necessarily has a negative value, and a negative sign is attached thereto.

[Expression 23]

$$d = -\frac{c}{4\pi f\sqrt{\varepsilon_{eff}}}\left(-\left|\tan^{-1}\left(\frac{|S_{11}|e^{j\phi_{11}}}{|S_{21}||S_{12}|e^{j(\phi_{21}+\phi_{12})}-|S_{11}||S_{22}|e^{j(\phi_{11}+\phi_{22})}}\right)\right|-\tan^{-1}\left(\frac{-2\omega C_g Z_o}{1-(\omega C_g Z_o)}\right)\right) \quad (23)$$

In a case where the artificial magnet conductor 10 having characteristics of a complete magnetic conductor only at a single frequency is produced, the thickness d of the dielectric substrate 12 corresponding to the frequency of the electromagnetic wave which is reflected may be calculated by using Expression (23). Here, the thickness d of the dielectric substrate 12 is determined based on an addition phase change amount which is obtained by adding the phase change amount $\phi_\varepsilon$ caused by the FSS 11 (frequency selective surface) to a phase change caused by the capacitance which is formed by the gap between the pattern of the patch 101 and the pattern of the loop 102 which are formed on the FSS 11, using Expression (23). That is, the phase change amount $\phi_\varepsilon$ (thickness phase change) which is determined only by the thickness of the dielectric substrate that is obtained by subtracting the phase change $\phi_g$ caused by $C_g$ from the phase rotation amount $\phi_{shift}$ required for the dielectric substrate 12 based on the S parameters of the FSS 11, and the thickness d of the dielectric substrate 12 is calculated from the phase change amount $\phi_\varepsilon$, using Expression (23).

Figure 13:
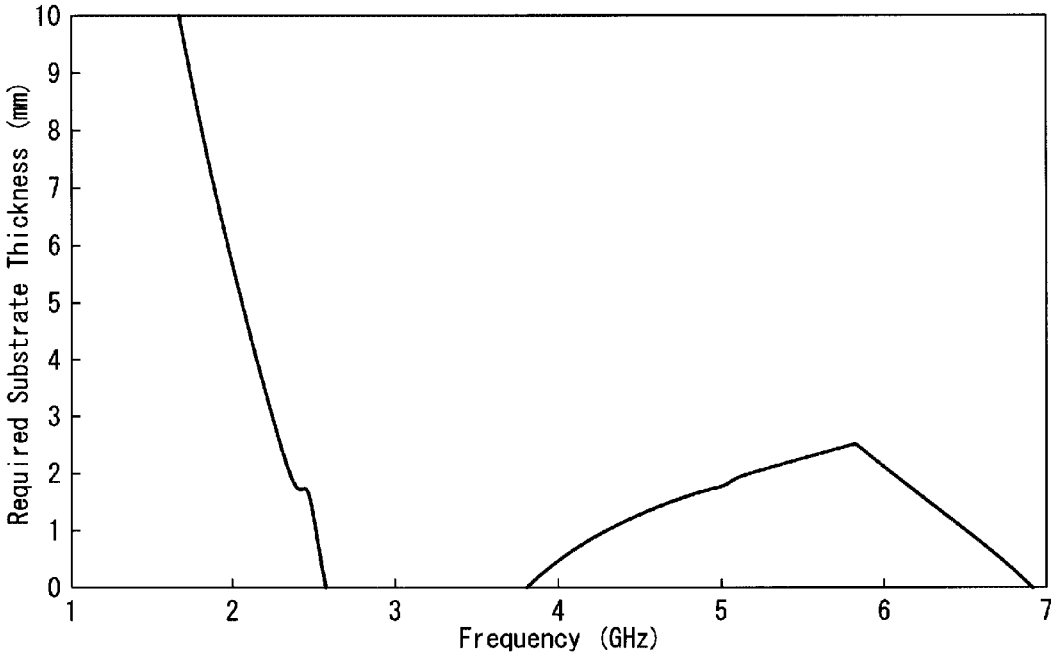
FIG. 13 is a graph illustrating a relationship between a thickness (required substrate thickness) d of the required dielectric substrate 12 and a frequency of the electromagnetic wave, which are obtained by Expression (23).

FIG. 13 is a graph illustrating a relationship between the thickness (required substrate thickness) d of the required dielectric substrate 12 and the frequency of the electromagnetic wave, which are obtained by Expression (23). In FIG. 13, a vertical axis denotes the thickness of the dielectric substrate 12, and a horizontal axis denotes the frequency of the electromagnetic wave. Here, 12 in a frequency region in which the thickness d of the dielectric substrate 12 is negative is not able to be produced. In a case of the present embodiment, a study on the thickness d of the dielectric substrate 12 for obtaining characteristics of a complete magnetic conductor in two frequency bandwidths different from each other is performed in relation to the artificial magnet conductor 10.

Figure 14:
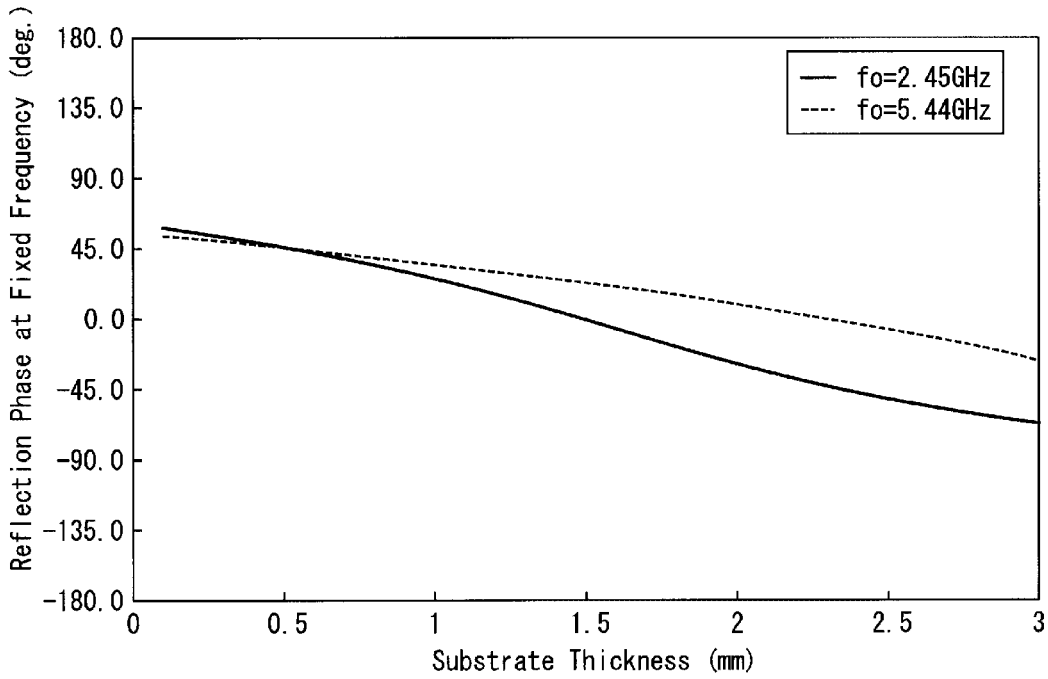
FIG. 14 is a graph illustrating a relationship between a reflection phase and the thickness (required substrate thickness) d of the dielectric substrate 12 that is required, which are obtained by Expression (23).
Figure 15:
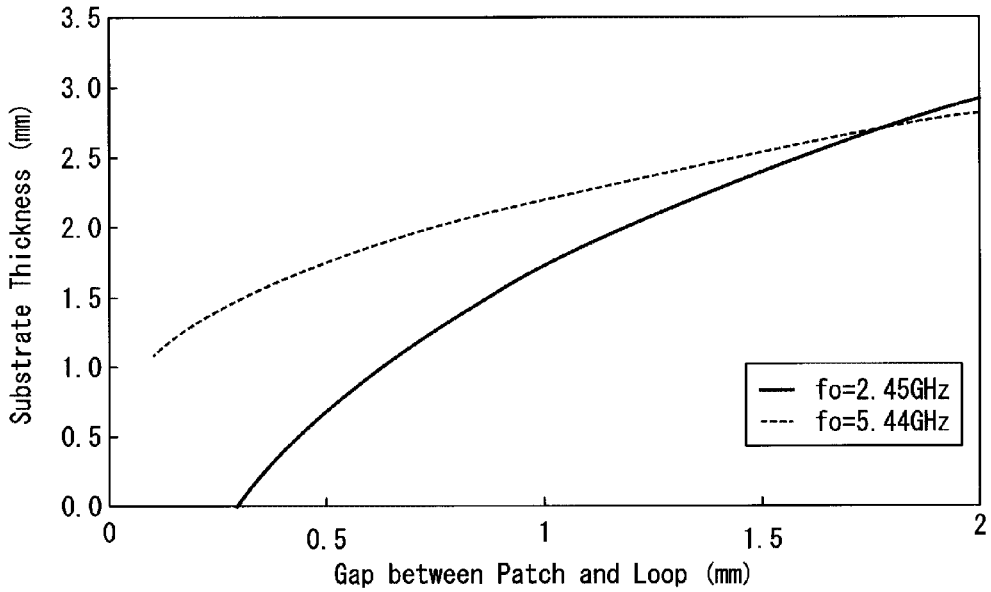
FIG. 15 is a diagram illustrating a relationship between the thickness d of the dielectric substrate 12 obtained by Expression (23), and a distance of a gap between a pattern of the patch 101 and a pattern of the loop 102 when the thickness is obtained.

FIG. 14 is a graph illustrating a relationship between the reflection phase $\phi_{shift}$ (reflection phase at fixed frequency) at a fixed frequency and the thickness (required substrate thickness) d of the dielectric substrate 12 that is required, which are obtained by Expression (23). In FIG. 15, a vertical axis denotes the reflection phase $\phi_{shift}$, and a horizontal axis denotes the thickness d of the dielectric substrate 12. In addition, a solid line denotes a change curve showing correspondence between the reflection phase $\phi_{shift}$ and the thickness d in a case where the frequency of electromagnetic wave is 2.45 GHz, and a dashed line denotes a change curve showing correspondence between the reflection phase $\phi_{shift}$ and the thickness d in a case where the frequency of electromagnetic wave is 5.44 GHz.

It is hard to determine the thickness d of the dielectric substrate 12 in FIG. 13. Accordingly, in FIG. 14, the thickness d of the dielectric substrate 12 changes, and correspondence between the thickness d of the dielectric substrate 12 and the reflection phase $\phi_{shift}$ is obtained as results in which the reflection phase is obtained by Expression (23). As can be seen from FIG. 4, if the thickness d of the dielectric substrate 12 is in a range of 0.5 mm to 2.3 mm, reflection phase $\phi_{shift}$ of the electromagnetic wave at the frequency of each of 2.45 GHz and 5.44 GHz is within ±45°, and thus, the characteristics of the artificial magnet conductor 10 can approach the characteristics of a complete magnetic conductor.

FIG. 15 is a diagram illustrating a relationship between the thickness d (Substrate Thickness) of the dielectric substrate 12 obtained by Expression (23), and the distance (Gap between Patch and Loop) of a gap between the pattern of the patch 101 and the pattern of the loop 102 when the thickness d is obtained. In FIG. 15, a vertical axis denotes the thickness d of the dielectric substrate 12, and a horizontal axis denotes the distance of the gap between the pattern of the patch 101 and the pattern of the loop 102. In addition, a solid line is a curve obtained in correspondence with the frequency of 2.45 GHz, while a dashed line is a curve obtained in correspondence with the frequency of 5.44 GHz.

Here, as illustrated in FIG. 14, if the thickness d of the dielectric substrate 12 is in a range of 0.5 mm to 2.3 mm, the reflection phase $\phi_{shift}$ of the electromagnetic wave at frequencies of each of 2.45 GHz and 5.44 GHz is within ±45°. It can be seen that, in a range in which the thickness d of the dielectric substrate 12 is 0.5 mm to 2.3 mm, the thickness d of the dielectric substrate 12 at frequencies of each of 2.45 GHz and 5.44 GHz is greater than the distance of the gap between the pattern of the patch 101 and the pattern of the loop 102 when the thickness is obtained. That is, in the graph of FIG. 15, the distance of the gap corresponding to an arbitrary thickness d in a range of 0.5 mm to 2.3 mm is shorter than the thickness d of the dielectric substrate 12, in coordinates on the curves of each of 2.45 GHz and 5.44 GHz.

Hence, when the thickness d of the dielectric substrate 12 is calculated by Expression (23), the thickness d of the dielectric substrate 12 is greater than the distance of the corresponding gap on the curve, in a range in which the thickness d of the dielectric substrate 12 is 0.5 mm to 2.3 mm. In addition, reflection phase $\phi_{shift}$ of the electromagnetic wave at frequencies of each of 2.45 GHz and 5.44 GHz is within ±45°, and the characteristics of the artificial magnet conductor 10 can approach the characteristics of a complete magnetic conductor, in a relationship between the thickness d of the dielectric substrate 12 and the distance of the gap.

Meanwhile, in a case where the artificial magnet conductor 10 having characteristics of a complete magnetic conductor only at a single frequency is produced, the thickness in which reflection phase $\phi_{shift}$ becomes 0° is set, and thereby, the complete magnetic conductor can be obtained. For example, in a case where the artificial magnet conductor becomes the complete magnetic conductor at a frequency of 2.45 GHz in a frequency of an incident electromagnetic wave, the thickness d of the dielectric substrate 12 becomes 1.5 mm, and thereby the artificial magnet conductor 10 of a complete magnetic conductor whose reflection phase is 0° at 2.45 GHz can be produced. In addition, in a case where the artificial magnet conductor becomes the complete magnetic conductor at a frequency of 5.44 GHz in a frequency of an incident electromagnetic wave, the thickness d of the dielectric substrate 12 becomes 2.3 mm, and thereby the artificial magnet conductor 10 of a complete magnetic conductor whose reflection phase is 0° at 5.44 GHz can be produced.

Accordingly, for example, a set value of the thickness d of the dielectric substrate 12 is set to 1.6 mm close to an average value of the dielectric substrate 12 in which a phase becomes 0° at frequencies of each of 2.45 GHz and 5.44 GHz. Thereby, in the present embodiment, in a case of being used as a reflection plate for an antenna, the thickness d of the dielectric substrate in which the reflection phase is within ±45° at two frequencies can be simply set, and a reflection pale which satisfies both to the two frequencies can be produced, based on Expression (23).

As described above, according to the present embodiment, as the thickness d of the dielectric substrate 12 is set by using a physical model in which the phase change $\phi_g$ occurring when an incident electromagnetic wave is propagated from an inductive pattern to a capacitive pattern as an evanescent wave is added to the phase rotation amount $\phi_\varepsilon$ of the dielectric substrate 12, and by using an expression which calculates the thickness of the dielectric substrate 12, the produced artificial magnet conductor 10 can have characteristics closer to a design value, and the artificial magnet conductor 10 which copes with a specific frequency bandwidth with high accuracy can be provided.

<Fine Adjustment of Frequency>

Next, description will be made with respect to adjustment of frequency characteristics which is made by changing a pattern shape, in a case where pattern shapes of the patch 101 and the loop 102 which configure the FSS 11 are configured by a polygon having apexes a triangle or more. The frequency characteristics denotes a frequency in which the reflection coefficient $S_{11}$ of the S parameter has a minimum value.

The adjustment of frequency characteristics is made by cutting (chamfering) a region of apexes by using a line perpendicular to lines connecting the apexes to the center of the polygon, in a pattern shape of the patch 101 which is configured by a polygon.

That is, the pattern shape of the patch 101 is changed to a polygonal shape with many apexes. In changing the pattern of the patch 101, adjustment of decreasing a frequency of the reflection coefficient $S_{11}$ of filter characteristics of the FSS 11 is made by increasing apexes of the pattern of the patch 101. At this time, a gap of a distance between a side of the inner circumference of the loop 102 surrounding the patch 101 and a side of the outer circumference of the patch 101 is the same at any location. Accordingly, the loop 102 is chamfered such that sides of the inner circumference thereof corresponds to sides of the outer circumference of the patch 101.

Figure 16:
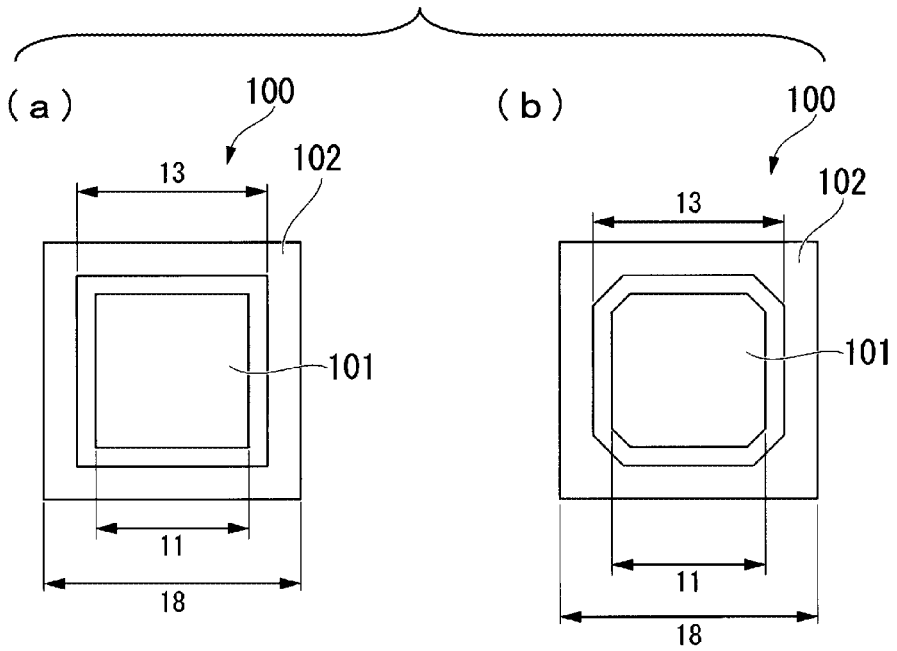
FIG. 16 is a conceptual view illustrating modification of pattern shapes of the patch 101 and the loop 102 which configure a basic cell 100 of the FSS 11.

FIG. 16 is a conceptual view illustrating modification of the pattern shapes of the patch 101 and the loop 102 which configure a basic cell 100 of the FSS 11. Numeric values of FIG. 16 denote dimension (unit is mm). FIG. 16(*a*) illustrates the basic cell 100 which is configured by the patch 101 with a pattern shape of a square. FIG. 16(*b*) illustrates the basic cell 100 which is configured by the patch 101 with an octagonal pattern shape by cutting regions of apexes of the patch 101 of FIG. 16(*a*).

In FIG. 16(*a*), an outer circumference of the patch 101 forms a square, and thus, an inner circumference of the loop 102 forms a square different from the patch 101. Meanwhile, in FIG. 16(*b*), an outer circumference of the patch 101 forms an octagon, and thus, an inner circumference of the loop 102 forms an octagon different from the patch 101.

Figure 17:
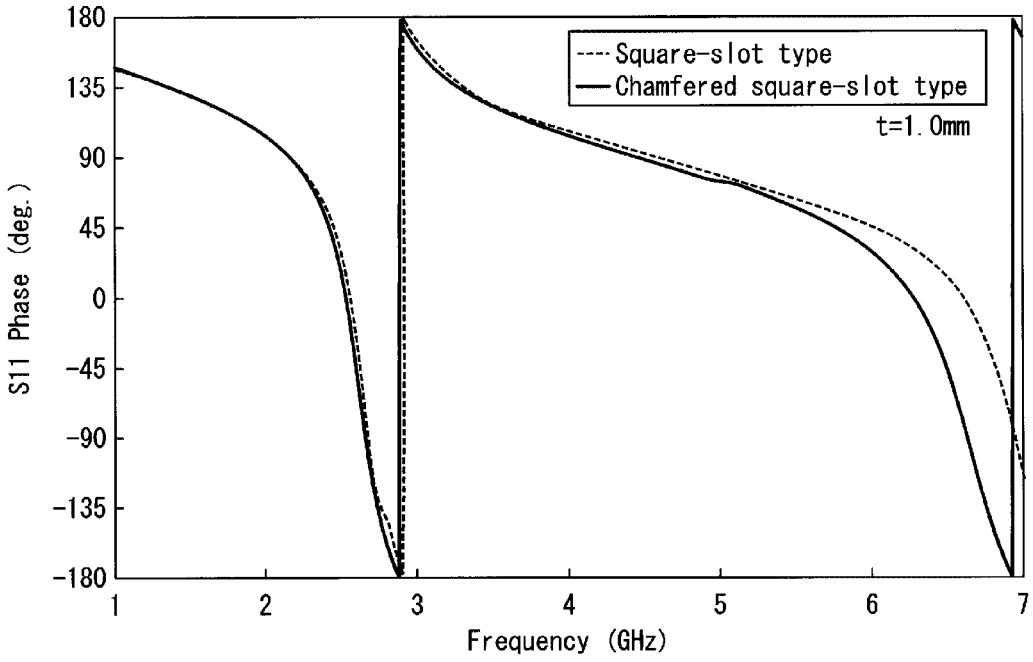
FIG. 17 is a diagram illustrating frequency characteristics of a filter with a pattern shape of each of the basic cells 100 illustrated in FIG. 16(*a*) and FIG. 16(*b*), for comparison.

FIG. 17 is a diagram illustrating frequency characteristics of a filter having a pattern shape of each of the basic cells 100 illustrated in FIG. 16(*a*) and FIG. 16(*b*), for comparison. In FIG. 17, a vertical axis denotes phase characteristics ($S_{11}$ phase) of the reflection coefficient $S_{11}$, and a horizontal axis denotes a frequency of an incident electromagnetic wave. The frequency characteristics are formed by the FSS 11 in which the basic cells 100 are arranged in a 3×3 matrix. A dashed line illustrates a relationship between the reflection coefficient $S_{11}$ in a case of the patch 101 having a rectangular pattern shape illustrated in FIG. 16(*a*) and a frequency of an incident electromagnetic wave. Meanwhile, a solid line illustrates a relationship between the reflection coefficient $S_{11}$ in a case of the patch 101 having an octagonal pattern shape illustrated in FIG. 16(*a*) and a frequency of an incident electromagnetic wave. As can be seen from FIG. 17, the reflection coefficient $S_{11}$ has minimum value at a lower frequency by performing chamfering. Hence, the patch is close to a ring shape by being gradually polygonised by chamfering, and thereby the phase characteristics of the reflection coefficient $S_{11}$ are changed to a low frequency side. Accordingly, the frequency characteristics of the reflection coefficient $S_{11}$ can be finely adjusted.

There are a triangle, a pentagon, a hexagon, an octagon, a decagon, or the like as a polygon which is used frequently and differently. However, it is considered that, as the number of chamfering is reduced, the patch becomes a shape close to a ring depending on a size of the patch, and a decrease of the frequency is saturated in a polygon having a certain number of apexes.

As described above, according to the present embodiment, chamfering of the patch 101 is performed form the basic cell 100, and chamfering of a shape of the inner circumference of the loop 102 is performed so as to correspond to the outer circumference of the chamfered patch 101, and thereby the phase characteristics of the reflection coefficient $S_{11}$ can be corrected (adjusted) toward a low frequency side without changing an area of the basic cell 100.

<Antenna Reflector which Uses Artificial Magnet Conductor>

As described in FIG. 2, the artificial magnet conductor 10 according to the present embodiment reflects the electromagnetic wave which is emitted from the antenna substrate 300, in an antenna device and emits the electromagnetic wave toward an emission direction of the electromagnetic wave of a directional antenna device. The artificial magnet conductor 10 according to the present embodiment is used as a reflection plate which reflects the electromagnetic wave.

The antenna reflector is mainly configured by the supporting body 200. The reflection plate of the artificial magnet conductor 10 is provided such that the reflection plate of the artificial magnet conductor 10 can be detached from the supporting body 200. That is, in the present embodiment, ends of the sides, which face each other, of the artificial magnet conductor 10 are inserted into the slits 202, and thereby, the artificial magnet conductor is provided so as to face the antenna substrate 300.

According to the present embodiment, the ends of the sides, which face each other, of the artificial magnet conductor 10 are inserted and fixed, and thus, the artificial magnet conductor 10 is configured to be detachable, and can be attached or detached depending on whether or not the antenna have directivity.

In addition, the artificial magnet conductor of the related art is not able to obtain frequency characteristics with higher accuracy than the design value, and thus, the frequency characteristics greatly deviates due to an error of disposition when being attachable or detachable.

However, according to the present embodiment, the artificial magnet conductor 10 having frequency characteristics with high accuracy corresponding to the design value is used as a reflection plate, and thus, it is possible to obtain frequency characteristics with higher accuracy than the artificial magnet conductor of the related approximation ray theory, although being attachable or detachable.

In addition, according to the present embodiment, the artificial magnet conductor is used for the reflection plate, and thus, the antenna reflector to which the reflection plate is attachable or detachable can be minimized, and the antenna device itself can be minimized.

Figure 18:
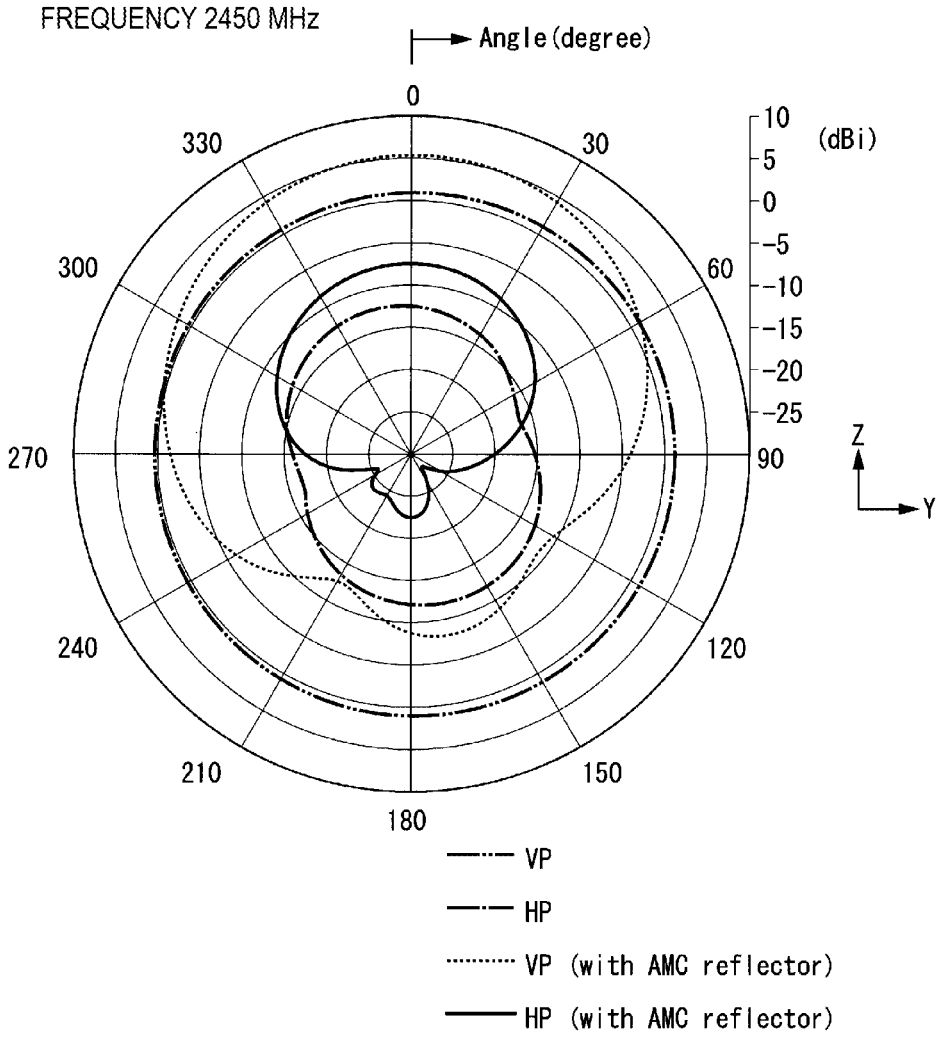
FIG. 18 is a radiation pattern diagram illustrating directivity when the artificial magnet conductor 10 which is produced in correspondence with 2.45 GHz is used as a reflection plate.

FIG. 18 is a radiation pattern diagram illustrating directivity when the artificial magnet conductor 10 which is produced in correspondence with 2.45 GHz is used as the reflection plate. In FIG. 18, an antenna pattern of an azimuth angle is denoted by polar coordinates, and an axis in a diameter direction of a ring denotes antenna gain (dBi). A reflection surface of the artificial magnet conductor 10 in FIG. 1 is perpendicular to a z direction, and thus, FIG. 18 illustrates an antenna pattern on an YZ plane.

A solid line denotes an emission pattern in a case where the artificial magnet conductor 10 according to the present embodiment is used as the reflection plate (HP: horizontal polarization, that is, a case of horizontal polarization). It can be seen that strength of a main lobe is greater than those of a back lobe and a side lobe, the reflector efficiently reflects the electromagnetic wave of 2.45 GHz, and the antenna device has directivity. A dashed line denotes the emission pattern in a case where the artificial magnet conductor 10 according to the present embodiment is used as the reflection plate (VP: vertical polarization, that is, a case of vertical polarization). The strength increases overall, compared to a case of a solid line, but it can be seen that the strength of the main lobe is greater than those of the back lobe and the side lobe, the reflector efficiently reflects the electromagnetic wave of 2.45 GHz, and the antenna device has directivity, in the same manner as in a case of the solid line.

Meanwhile, an alternate long and short dash line denotes an emission pattern in a case of deviating the reflection plate (a case of HP). It can be seen that each of the main lobe, the back lobe, and the side lobe has the same strength, the reflector reflects the electromagnetic wave of 2.45 GHz in all directions, and the antenna device does not have directivity. An alternate long and two short dashes line denotes an emission pattern in a case of deviating the reflection plate (a case of VP). It can be seen that each of the main lobe, the back lobe, and the side lobe has the same strength, the reflector reflects the electromagnetic wave of 2.45 GHz in all directions, and the antenna device does not have directivity, in the same manner as the alternate long and short dash line.

Figure 19:
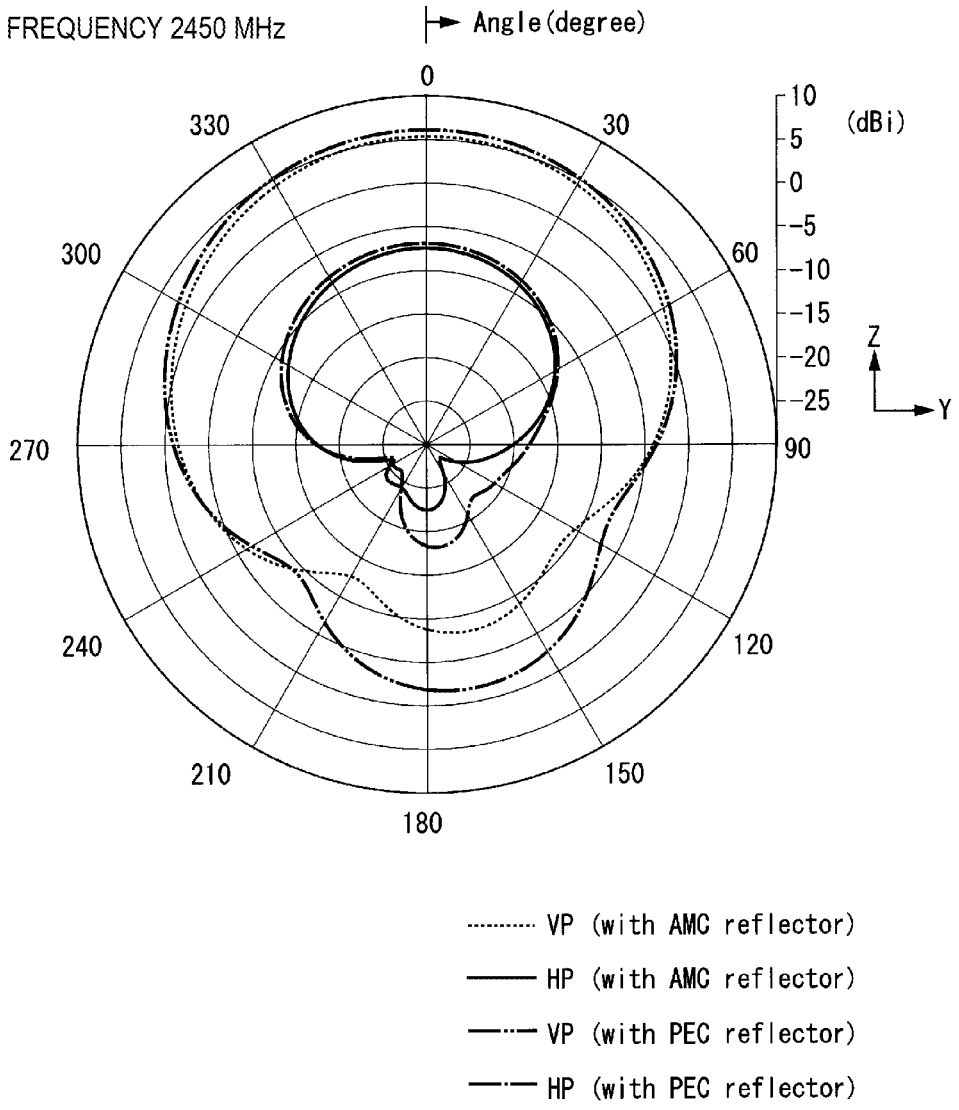
FIG. 19 is a radiation pattern diagram illustrating directivity of an antenna in a case where the artificial magnet conductor 10 (AMC, complete magnetic conductor) which is produced in correspondence with 2.45 GHz is used as a reflection plate, and in a case where a complete magnetic conductor (PEC) such as copper is used as a reflection plate.

FIG. 19 is a radiation pattern diagram illustrating directivity of the antenna in a case where the artificial magnet conductor 10 (AMC, complete magnetic conductor) which is produced in correspondence with 2.45 GHz is used as the reflection plate, and in a case where a complete magnetic conductor (PEC) such as copper is used as the reflection plate. In FIG. 19, an antenna pattern of an azimuth angle is denoted by polar coordinates, and an axis in a diameter direction of a ring denotes antenna gain (dBi), in the same manner as in FIG. 18. A reflection plane of the artificial magnet conductor 10 in FIG. 1 is perpendicular to the z direction, and thus, FIG. 19 illustrates the antenna pattern on the YZ plane.

A solid line denotes the emission pattern in a case where the artificial magnet conductor 10 according to the present embodiment is used as a reflection plate (a case of horizontal polarization). A dashed line denotes the emission pattern in a case where the artificial magnet conductor 10 according to the present embodiment is used as the reflection plate (a case of vertical polarization). It can be seen from the solid line and the dashed line that strength of a main lobe is greater than that of a back lobe, the reflector efficiently reflects the electromagnetic wave of 2.45 GHz, and the antenna device has directivity.

Meanwhile, an alternate long and short dash line denotes an emission pattern in a case where the complete electric conductor according to the present embodiment is used as the reflector (a case of HP). An alternate long and two short dashes line denotes an emission pattern in a case where the complete electric conductor is used as the reflector (a case of VP). It can be seen from the alternate long and short dash line and the alternate long and two short dashes line that strength of a main lobe is greater than that of a back lobe, but a ratio between the main lobe and the side lobe is less than a ratio in a case when the artificial magnet conductor 10 according to the present embodiment is used as the reflection plate.

Hence, in a case where the artificial magnet conductor 10 according to the present embodiment is used, it is possible to increase emission directivity of the electromagnetic wave of 2.45 GHz, compared to a case where the complete electric conductor of the related approximation ray theory is used. In addition, in a case where the complete electric conductor of the related art is used as the reflection plate, a separated distance between the antenna substrate and the reflection plate needs to be 30 mm or more, and in a case where the artificial magnet conductor 10 according to the present embodiment is used, the separated distance is approximately 15 mm. Accordingly, it is possible to minimize the antenna device more than that of the related art.

Figure 20:
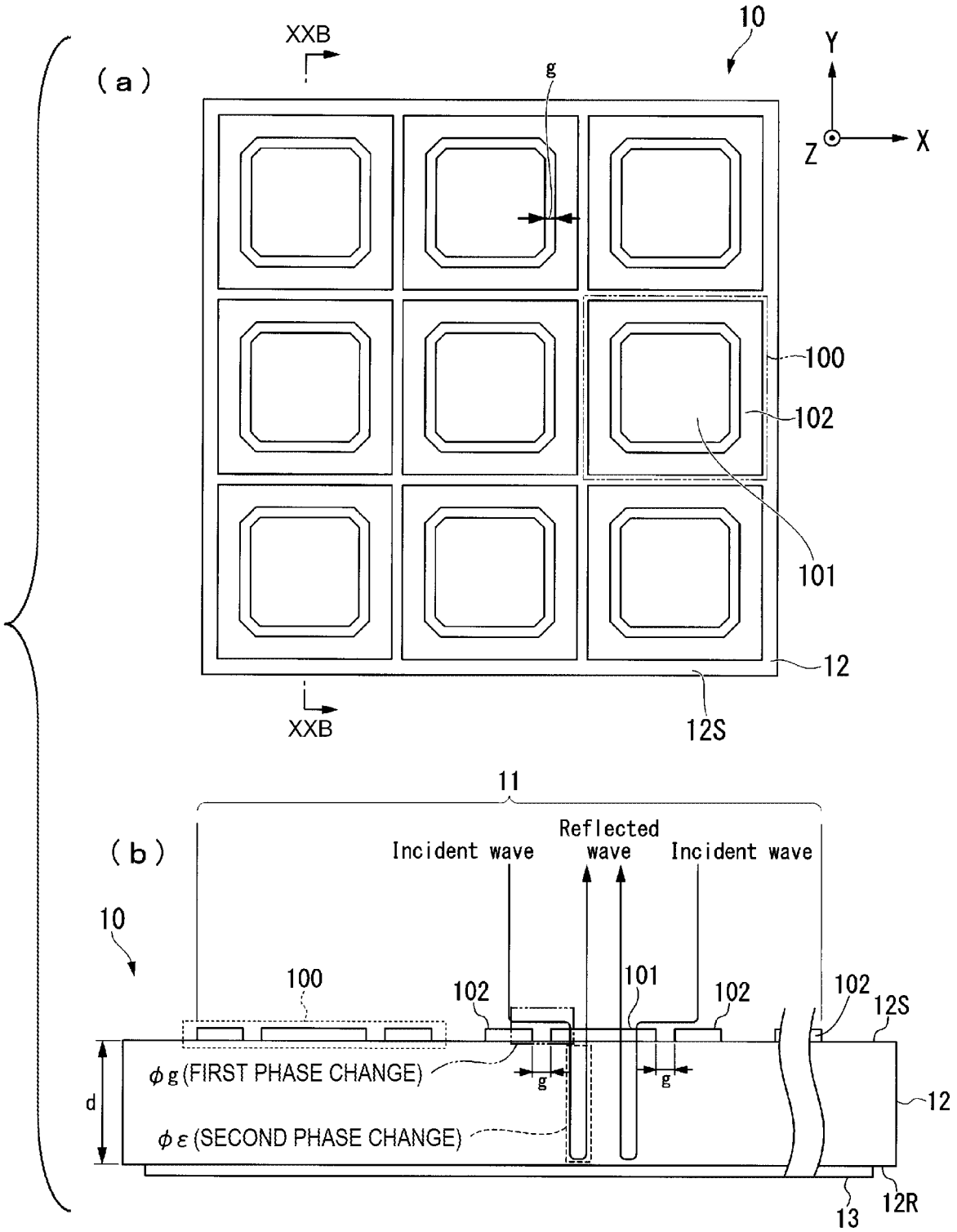
FIG. 20 is a view illustrating concept of obtaining a phase change amount between an incident wave and a reflected wave of the artificial magnet conductor according to the present invention.

FIG. 20 is a view illustrating concept of obtaining a phase change amount between an incident wave and a reflected wave of the artificial magnet conductor according to the present invention. In FIG. 20, FIG. 20(*a*) illustrates a front surface 12S of the dielectric substrate 12 in a planar view. In addition, FIG. 20(*b*) is a cross-sectional view taken along line XXB-XXB in the artificial magnet conductor of FIG. 20(*a*). As illustrated in FIG. 20, the FSS (Frequency Selective Surface) 11 in which the basic cells 100 are periodically arranged in a matrix is formed on the front surface 12S of the dielectric substrate 12. Here, the basic cell 100 is configured with the patch 101 which is a patch pattern, and the loop 102 which is a loop pattern that is formed to have a predetermined gap (distance g) with the patch 101. In addition, the ground plate 13 (conductive film) that is a conductive film formed to overlap a region in which the basic cells 100 are arranged in a planar view is formed on a rear surface 12R of the dielectric substrate 12.

In the present invention, when the thickness d of the dielectric substrate 12 is obtained, a phase change from the incident wave toward the reflected wave with respect to the dielectric substrate 12 is obtained as an addition value which is obtained by adding the phase change $\phi_g$ (first phase change) in the gap of the distance g to the phase change amount $\phi_\varepsilon$ (second phase change) between the basic cell 100 and the ground plate 13 (conductive film) in the dielectric substrate 12. In addition, the thickness d of the dielectric substrate 12 is calculated by a predetermined expression (for example, expression (23)), based on the obtained addition value.

That is, FIG. 20(*b*) illustrates a correspondence relationship between the phase change $\phi_g$ (first phase change) and the phase change amount $\phi_\varepsilon$ (second phase change). As previously described, the phase change (addition value) of the reflected wave from the artificial magnet conductor 10 is a numeric value which is obtained by adding the phase change $\phi_g$ (first phase change) caused by the capacitance $C_g$ which is formed by the gap (distance g) between the loop 101 and the loop 102, to the phase change amount $\phi_\varepsilon$ (second phase change) based on the thickness d of the dielectric substrate 12. The phase change $\phi_g$ (first phase change) occurs as the evanescent wave generated by a pattern of inductive reactance is transferred to capacitive pattern through the capacitance $C_g$.

In FIG. 20(*b*), for example, in a case where the electromagnetic wave (incident wave) which is incident on the artificial magnet conductor 10 is 2.45 GHz, the loop 102 has inductive reactance, and the patch 101 has capacitive reactance. Accordingly, the evanescent wave is generated by the loop 102, and is transferred to the patch 101 through the capacitance $C_g$ between the patch 101 and the loop 102.

Meanwhile, in a case where the electromagnetic wave (incident wave) which is incident on the artificial magnet conductor 10 is 5.44 GHz, the patch 101 has inductive reactance, and 102 has capacitive reactance. Accordingly, the evanescent wave is generated by the patch 101, and is transferred to the loop 102 through the capacitance $C_g$ between the patch 101 and the loop 102.

Even in a case where the incident wave is either 2.45 GHz or 5.44 GHz, the evanescent wave which is generated by the pattern of inductive reactance is transferred to the capacitive reactance through the capacitance $C_g$, and thereby the phase change $\phi_g$ (first phase change) which occurs is the same as each other.

In addition, the phase change $\phi_g$ (first phase change) occurs depending on a distance in which the evanescent wave is transferred between the pattern 102 and the pattern 102, in the FSS (Frequency Selective Surface) 11. Thereafter, the evanescent wave is incident on the dielectric substrate 12 from the pattern 101, and is reflected by an interface between the dielectric substrate 12 and the ground plate 13 (conductive film), and the phase rotation amount $\phi_\varepsilon$ (second phase change) depending on the thickness d of the dielectric substrate 12 occurs. That is, the phase rotation amount $\phi_\varepsilon$ (second phase change) is a phase change which occurs between the basic cell 100 and the ground plate 13 (conductive film). Hence, the phase change from the incident wave toward the reflected wave is a numeric value which is obtained by adding the phase change $\phi_g$ (first phase change) to the phase rotation amount $\phi_\varepsilon$ (second phase change). Hence, in the present invention, the phase rotation amount $\phi_\varepsilon$ (second phase change) which is a phase change amount based on the thickness d of the dielectric substrate 12 is obtained by subtracting the phase change $\phi_g$ (first phase change) from the phase change from the incident wave toward the reflected wave with respect to the dielectric substrate 12 that is obtained as the addition value, and the thickness d of the dielectric substrate 12 is calculated by a predetermined expression (for example, expression (23)).

In the example of FIG. 20, the ground plate 13 is formed as a conductive film, but the ground plate 13 is not limited to a conductive film. That is, the ground plate 13 may be formed as a conductive layer.

The dielectric substrate 12 may be a medium which configures a conductor, and may use a conductive medium, such as an ABS resin, aluminum oxide (commonly known as alumina), or ceramics.

Processing of designing the artificial magnet conductor may be performed by recording a program for executing expression processing of designing the artificial magnet conductor according to the present invention in a computer readable recording medium, reading the program recorded in the recording medium into a computer system, and executing the program. Here, it is assumed that the "computer system" includes hardware such as OS or a peripheral device. In addition, it is assumed that the "computer system" includes a WWW system which includes home page providing environment (or display environment). In addition, the "computer readable recording medium" is a recording medium, for example, a portable medium, such as a flexible disk, a magneto-optical disk, a ROM, or a CD-ROM, a hard disk which is embedded in the computer system, or the like. Furthermore, it is assumed that the "computer readable recording medium" includes an apparatus which retains a program for a predetermined time, such as a server in a case where a program is transmitted through a network such as Internet or a communication line such as a telephone line, or a volatile memory (RAM) embedded in a computer system which is a client.

In addition, the program may be transferred from a computer system including a storage device or the like to which the program is stored to another computer system through a transfer medium or by a carrier wave in the transfer medium. Here, the "transfer medium" which transfers the program indicates a medium having a function of transferring information, such as, a network such as Internet, or a communication line such as a telephone line. In addition, the program may be means for performing a part of the aforementioned function. Furthermore, the program may be means for performing the aforementioned function by combining the function with a program stored in the computer system, that is, a differential file (differential program).

The present application is based upon the Japanese Patent Application No. 2014-115956; filed on Jun. 4, 2014; the contents of which are incorporated herein by reference.

REFERENCE SIGNS LIST

10: artificial magnet conductor
11: FSS
12: dielectric substrate
13: ground plate
100: basic cell
101: patch
102: loop
200: supporting body
200A, 200B: surface
201: fixing wall
202: slit
250: hole
300, 310: antenna substrate

The invention claimed is:

1. An artificial magnet conductor comprising:

a dielectric medium;

basic cells, each being formed on a side of a front surface of the dielectric medium, and including a conductive patch pattern and a conductive loop pattern that is formed with a predetermined gap with the conductive patch pattern;

a frequency selective surface on which the basic cells are periodically arranged on the front surface of the dielectric medium; and a conductive layer that is formed on a side of a rear surface of the dielectric medium, wherein a phase change from an incident wave to a reflected wave with respect to the dielectric medium is set as an addition value in which a first phase change in the gap is added to a second phase change between the basic cell of the dielectric medium and the conductive layer, and a thickness of the dielectric medium is set based on the addition value, and the thickness of the dielectric medium is greater than a distance of the gap when the thickness is calculated.

2. The artificial magnet conductor according to claim 1, wherein the dielectric medium is a dielectric substrate.

3. The artificial magnet conductor according to claim 1, wherein the thickness of the dielectric medium is set by a predetermined expression using the addition value.

4. The artificial magnet conductor according to claim 1, wherein the addition value is an addition phase change amount in which the second phase change which is a phase rotation amount is added to the first phase change caused by capacitance which is formed by the gap.

5. The artificial magnet conductor according to claim 3, wherein the predetermined expression is an expression that subtracts the first phase change from a phase change amount which is obtained based on an S parameter of the frequency selective surface and is required for the dielectric medium, calculates the second phase change which is obtained as the subtraction results, and calculates the thickness of the dielectric medium from the second phase change.

6. The artificial magnet conductor according to claim 1, wherein the frequency selective surface is formed such that one of the conductive patch pattern and the conductive loop pattern has inductive reactance, and the other has capacitive reactance, at a predetermined frequency bandwidth.

7. The artificial magnet conductor according to claim 1, wherein the thickness of the dielectric medium is set such that the artificial magnet conductor has frequency characteristics corresponding to a plurality of frequencies, change curves of a dielectric thickness and a phase in each of the plurality of frequencies are obtained, and the phase is within ±45° of the entirety of the plurality of frequencies.

8. The artificial magnet conductor according to claim 1, wherein the conductive patch pattern is formed in a polygon, and the frequency characteristics of the frequency selective surface are adjusted by further increasing the number of apexes by cutting regions of apex portions of the polygon in a direction perpendicular to a line connecting the apexes to a center of the polygon.

9. An antenna reflector comprising:

the artificial magnet conductor according to claim 1, which is used as a reflection plate.

10. The antenna reflector according to claim 9, wherein the artificial magnet conductor is provided to be detachable.

11. A method for calculating a thickness of a dielectric medium of an artificial magnet conductor including a dielectric medium; basic cells, each being formed on a side of a front surface of the dielectric medium, and including a conductive patch pattern and a conductive loop pattern that is formed with a predetermined gap with the conductive patch pattern; a frequency selective surface on which the basic cells are periodically arranged on the front surface of the dielectric medium; and a conductive layer that is formed on a side of a rear surface of the dielectric medium, the method comprising:

setting a phase change from an incident wave to a reflected wave with respect to the dielectric medium, as an addition value in which a first phase change in the gap is added to a second phase change between the basic cell of the dielectric medium and the conductive layer; and calculating the thickness of the dielectric medium based on the addition value, wherein the thickness of the dielectric medium is greater than a distance of the gap when the thickness is calculated.

12. The method according to claim 11, wherein the dielectric medium is a dielectric substrate.

13. The method according to claim 11, wherein the thickness of the dielectric medium is set by a predetermined expression using the addition value.

14. The method according to claim 11, wherein the addition value is an addition phase change amount in which the second phase change which is a phase rotation amount is added to the first phase change caused by capacitance which is formed by the gap.

15. The method according to claim 13, wherein the predetermined expression is an expression that subtracts the first phase change from a phase change amount which is obtained based on an S parameter of the frequency selective surface and is required for the dielectric medium, calculates the second phase change which is obtained as the subtraction results, and calculates the thickness of the dielectric medium from the second phase change.

16. The method according to claim 11, wherein the frequency selective surface is formed such that one of the conductive patch pattern and the conductive loop pattern has inductive reactance, and the other has capacitive reactance, at a predetermined frequency bandwidth.

17. The method according to claim 11, wherein the thickness of the dielectric medium is set such that the artificial magnet conductor has frequency characteristics corresponding to a plurality of frequencies, change curves of a dielectric thickness and a phase in each of the plurality of frequencies are obtained, and the phase is within ±45° of the entirety of the plurality of frequencies.

18. The method according to claim 11, wherein the conductive patch pattern is formed in a polygon, and the frequency characteristics of the frequency selective surface are adjusted by further increasing the number of apexes by cutting regions of apex portions of the polygon in a direction perpendicular to a line connecting the apexes to a center of the polygon.

* * * * *